US005354389A

United States Patent [19]

Arai et al.

[11] Patent Number: 5,354,389

[45] Date of Patent: Oct. 11, 1994

[54] METHOD OF MANUFACTURING SILICON STEEL SHEET HAVING GRAINS PRECISELY ARRANGED IN GOSS ORIENTATION

[75] Inventors: Kenichi Arai; Kazushi Ishiyama, both of Sendai; Yasushi Tanaka, Tokyo; Akira Hiura, Tokyo; Misao Namikawa, Tokyo, all of Japan

[73] Assignee: NKK Corporation, Tokyo, Japan

[21] Appl. No.: 920,127

[22] Filed: Jul. 24, 1992

[30] Foreign Application Priority Data

| | | | |
|---|---|---|---|
| Jul. 29, 1991 | [JP] | Japan | 3-210363 |
| Jul. 29, 1991 | [JP] | Japan | 3-210364 |
| Jul. 29, 1991 | [JP] | Japan | 3-210365 |
| Jul. 13, 1992 | [JP] | Japan | 4-185374 |
| Jul. 13, 1992 | [JP] | Japan | 4-185375 |
| Jul. 13, 1992 | [JP] | Japan | 4-185376 |

[51] Int. Cl.[5] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 3,089,795 | 5/1963 | Hu | 148/111 |
| 3,152,929 | 10/1964 | Weiner et al. | 148/111 |
| 3,586,545 | 6/1971 | Stanley | 148/111 |
| 3,841,924 | 10/1974 | Sakakura et al. | 148/111 |
| 3,932,234 | 1/1976 | Imanaka et al. | 148/112 |
| 4,469,533 | 9/1984 | Inokuti et al. | 148/111 |
| 4,473,416 | 9/1984 | Kawamo | 148/111 |

FOREIGN PATENT DOCUMENTS

| | | | |
|---|---|---|---|
| 0047129 | 3/1982 | European Pat. Off. . | |
| 0229846 | 7/1987 | European Pat. Off. . | |
| 0234443 | 9/1987 | European Pat. Off. . | |
| 0390142 | 10/1990 | European Pat. Off. . | |
| 2316808 | 11/1973 | Fed. Rep. of Germany . | |
| 40-15644 | 7/1940 | Japan . | |
| 51-13469 | 4/1976 | Japan . | |
| 62-67115 | 3/1987 | Japan | 148/111 |
| 64-55339 | 3/1989 | Japan . | |
| 2-57635 | 2/1990 | Japan . | |
| 2101631 | 1/1983 | United Kingdom . | |

OTHER PUBLICATIONS

Patent Abstracts of Japan, vol. 14, No. 232, (C-719) (4175), May 17, 1990; & JP-A-257635, (Babcock Hitachi), Feb. 27, 1990.

*Primary Examiner*—John P. Sheehan

*Attorney, Agent, or Firm*—Frishauf, Holtz, Goodman & Woodward

[57] ABSTRACT

The present invention provides a method of manufacturing a silicon steel sheet having grains precisely arranged in the Goss orientation, comprising the steps of preparing a steel material containing 0.01 wt. % or less of C, 2.5 to 7.0 wt. % of Si, 0.01 wt. % or less of S, 0.01 wt. % or less of Al, 0.01 wt. % or less of N, subjecting the steel material to hot rolling maintained 1000° C. or higher such that the temperature of the rolled material at an end of the hot rolling step falls within the range of 700 to 950° C., subjecting the steel material to a primary cold rolling process at a rolling reduction of 30 to 85%, annealing the steel material at a temperature of 600° to 900° C., subjecting the steel material to a secondary cold rolling process at a rolling reduction of 40 to 80%, annealing the steel material again at a temperature of 600°to 900° C., subjecting the steel material to a tertiary cold rolling process at a rolling reduction of 50 to 75%, and annealing the steel material in a reducing atmosphere, or in a non-oxidizing atmosphere having an oxygen partial pressure of 0.5 Pa or less, or in a vacuum having an oxygen partial pressure of 0.5 Pa or less, at a temperature in the range of 1000° to 1300° C.

10 Claims, 17 Drawing Sheets

METHOD OF MANUFACTURING SILICON STEEL SHEET HAVING GRAINS PRECISELY ARRANGED IN GOSS ORIENTATION

BACKGROUND OF THE INVENTION

1. Field of the Invention

The present invention relates to a method of manufacturing a silicon steel sheet having grains precisely arranged in the Goss orientation.

2. Description of the Related Art

Grain-oriented silicon steel sheets have better magnetic properties than non-oriented ones, and are mainly employed as the core material of transformers. After Goss's invention for the method of manufacturing a silicon steel sheet having all the crystal grains oriented in {110} <001> orientation, there have been proposed a number of methods of manufacturing a grain-oriented silicon steel sheet having a Goss texture. These proposed methods have been classified mainly into three categories as follows:

The first category is directed to the two-time cold press method. This method is a remodeled version of Goss's method, and in the two-stage cold rolling method, Mn, Sb, S, Se, and the like are added to the material in the steel refining process, and the secondary recrystallization is carried out by utilizing the crystal grain growth inhibiting effects of these elements themselves, and the fine precipitates thereof. More specifically, a steel ingot having a composition of C: 0.02 to 0.08wt. %, Si: 2.0 to 4.0 wt. %, Mn: about 0.2 wt. %, and S: 0.005 to 0.05 wt. %, is melted and subjected to a hot rolling process to make a sheet having a thickness of 2.0 to 3.0 mm. Then, the hot-rolled sheet is annealed, and subjected to a cold rolling process, the rolling reduction of which is about 70%. After that, again, intermediate annealing is carried out at a medium temperature in the range of 850° to 1050° C., and subjected to a cold rolling process of a rolling reduction of 60 to 70%. Further, after a decarburization-annealing process is performed at 800° to 850° C., an annealing process is again conducted at a temperature of 1100° C. or higher for 5 to 50 hours for the secondary recrystallization and removal of the inhibitors (purification-annealing). Thus, Goss grains are grown (see for example, Published Examined Japanese Patent Application No. 51-13469).

The second category is directed to the one-stage cold rolling method. In this method, the cold rolling process is carried out once, and this method is known to produce a sheet having a better Goss texture rate than the two-time cold rolling method. More specifically, a steel ingot having a composition of C: 0.02 to 0.08 wt. %, Si: 2.0 to 4.0 wt. %, Mn: about 0.2 wt. %, and N: 0.01 to 0.05 wt. %, and Al: about 0.1 wt. %, is melted and subjected to a hot rolling process to make a sheet having a thickness of 2.0 to 3.0 mm. Then, the hot-rolled sheet is annealed, and subjected to an AlN deposition process. Then, the sheet is subjected to a cold rolling process of a rolling reduction of 80 to 95%, and a decarburization-annealing process is performed. After some time, an annealing process is again conducted at a high temperature of 1200° C. for 20 hours for the secondary recrystallization and removal of the inhibitors (purification-annealing). Thus, Goss grains are grown (see, for example, Published Examined Japanese Patent Application (PEJPA) No. 40-15644).

The third category is directed to the method in which the Goss texture is created without using inhibitors (see, for example, Published Unexamined Japanese Patent Applications (PUJPA) No. 64-55339 and No. 2-57635, etc.). In this method, a rolling process and a heat treatment are simply combined with each other under a particular condition to grow Goss grains.

As described, the decarburization-annealing and purification-annealing are essential to the methods of the first and second categories. Since these annealing processes are each performed at a high temperature and for a long period of time, it is impossible to keep the production cost and equipment cost low.

Further, if the final product, sheet is formed to have a thickness of 0.20 mm or less to reduce the iron loss, the secondary recrystallization becomes unstable, and thus it is difficult to occupy all the surfaces with Goss grains. With the latest technique, the minimum thickness of the sheet is about 0.23 mm.

The method of the third category does not require decarburization-annealing, or purification-annealing; therefore this method is more cost effective in production than those of the first and second categories. However, the inventors of the present invention conducted tests to verify the methods disclosed in PUJPAs No. 64-55339 and 2-57635, and found out that the Goss grain growth mechanism is unstable, and therefore materials having all surfaces covered with Goss grains are not always obtained. Thus, it is difficult to obtain a stable quality. It should be emphasized here that a stable Goss grain growth is practically essential to a grain-oriented silicon steel sheet. Even if the product sheet is used after removing the section of other than the Goss grains, the production cost becomes high due to a poor yield.

SUMMARY OF THE INVENTION

The object of the invention is to provide a method of manufacturing a silicon steel sheet having grains precisely arranged in the Goss orientation, and exhibiting good magnetic properties, at a low production cost.

According to an aspect of the present invention, there is provided a method of manufacturing a silicon steel sheet having grains precisely arranged in the Goss orientation, comprising the steps of preparing a steel material containing 0.01 wt. % or less of C, 2.5 to 7.0 wt. % of Si, 0.01 wt. % or less of S, 0.01 wt. % or less of Al, 0.01 wt. % or less of N; subjecting the steel material maintained at 1000° C. or higher to a hot rolling process such that the temperature of the rolled material at the end of the hot rolling step falls with in the range of 700° to 950° C.; subjecting the steel material to a primary cold rolling process at a rolling reduction of 30 to 85%; annealing the steel material at a temperature of 600° to 900° C.; subjecting the steel material to a secondary cold rolling process at a rolling reduction of 40 to 80%; annealing the steel material again at a temperature of 600° to 900° C.; subjecting the steel material to a tertiary cold rolling process at a rolling reduction of 50 to 75%; and annealing the steel material in a reducing atmosphere, or in a non-oxidizing atmosphere having an oxygen partial pressure of 0.5 Pa or less, or in a vacuum having an oxygen partial pressure of 0.5 Pa or less, at a temperature of 1000° to 1300° C.

According to another aspect of the present invention, there is provided a method of manufacturing a silicon steel sheet having grains precisely arranged in the Goss orientation, comprising the steps of preparing a steep material containing 0.01 wt. % or less of C, 2.5 to 7.0 wt. % of Si, 0.01 wt. % or less of S, 0.01 wt. % or less of Al, 0.01 wt. % or less of N; subjecting the steel material maintained at 1000° C. or higher to a hot rolling process such that the temperature of rolled material at the end of the hot rolling step falls within the range of 700° to 950° C.; subjecting the steel material to a primary cold rolling process at a rolling reduction of 40% or more; subjecting the steel material to a primary annealing at a temperature of 600° to 900° C.; subjecting the steel material to a secondary cold rolling process at a rolling reduction of 50 to 80%; and subjecting the steel material to a secondary annealing a reducing atmosphere, or in a non-oxidizing atmosphere having an oxygen partial pressure of 0.5 Pa or less, or in a vacuum having an oxygen partial pressure of 0.5 Pa or less, at a temperature of 1000° to 1300° C.

According to still another aspect of the present invention, there is provided a method of manufacturing a silicon steel sheet having grains precisely arranged in the Goss orientation, comprising the steps of preparing a steep material containing 0.01 wt. % or less of C, 2.5 to 7.0 wt. % of Si, 0.01 wt. % or less of S, 0.01 wt. % or less of Al, 0.01 wt. % or less of N; subjecting the steel material maintained at 1000° C. or higher to a hot rolling process such that the temperature of the rolled material at the end of the hot rolling step falls within the range of 700° to 950° C.; subjecting the steel material to a cold rolling process at a rolling reduction of 40 to 80%; and annealing the steel material in a reducing atmosphere, or in a non-oxidizing atmosphere having an oxygen partial pressure of 0.5 Pa or less, or in a vacuum having an oxygen partial pressure of 0.5 Pa or less, at a temperature of 1000° to 1300° C.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
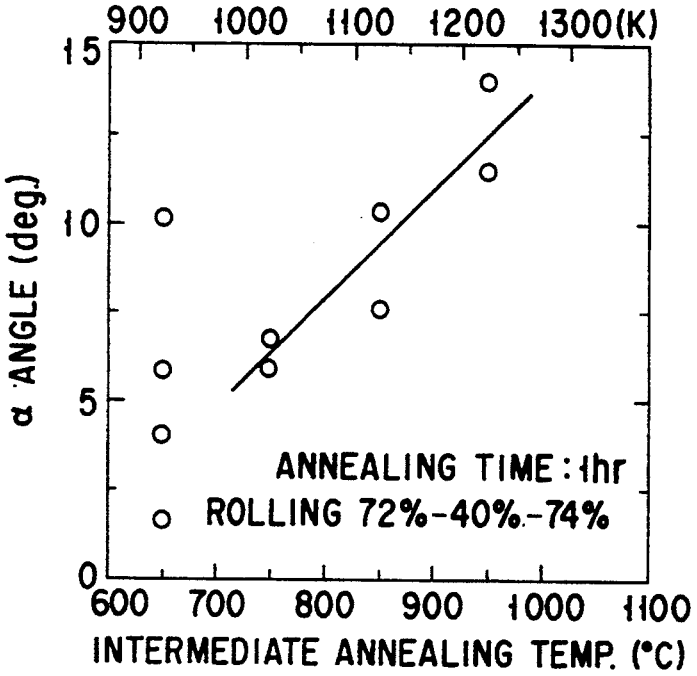
FIG. 1 is a graph showing the relationship between an intermediate annealing temperature and an angle $\alpha$ of the Goss texture in the case where the primary, secondary, and tertiary rolling reductions are 72%, 40%, and 74%, respectively.

The inventors of the present invention conducted intensive studies regarding influences of components in steel, hot-rolling conditions, cold-rolling conditions, and annealing conditions, on the basis of contents not requiring purification-annealing. As analyzing the results of the studies, the inventors found that Goss grains stably grow on all the surfaces of the silicon steel sheet at the final stage, by defining the steel composition in a particular range, and limiting the above-mentioned production conditions to a narrow range. Thus, the present invention has been achieved based on the above-described intensive studies by the inventors.

The basic construction of the invention is as follows:

A steel material having a particular composition is subjected to hot rolling under a certain condition. Further, in the first embodiment, cold rolling and annealing are each performed 3 times under particular conditions, in the second embodiment, each performed 2 times under particular conditions, and in the third embodiment, each performed once under particular conditions.

The composition of the steel material will be explained.

The steel material employed in the invention is that containing 0.01 wt. % or less of C, 2.5 to 7.0 wt. % of Si, 0.01 wt. % or less of S, 0.01 wt. % or less of Al, and 0.01 wt. % of N. In addition, it is preferable that the content of Cu be limited to 0.01 wt. % or less.

The content of each of the components is limited, for the following reasons.

The content of C should be reduced as much as possible while the material is still in the steel refining process, in order to obtain good magnetic properties. When the content of C exceeds 0.01 wt. %, the magnetic properties are significantly degraded. Thus, the upper range of carbon is set at 0.01 wt. %.

Si serves to increase electrical resistance, and when the content thereof is 2.5 wt. % or more, Si has the ability to make the metallic transformation point of iron vanish and make the steel material in the $\alpha$ phase. Further, when the Si content is around 6.5%, because of its zero magnetostriction, and therefore excellent soft magnetic properties can be obtained. However, when it exceeds 7.0 wt. %, the magnetostriction starts to increase again, degrading the magnetic properties, and the material is mechanically brittle. Thus, the Si content is set between the range of 2.5 to 7.0 wt. %.

Although S and N are typical elements contained in steel, these elements should be decreased in amount as much as possible since they inhibit the growth of grains in the dissolved state and the preeipetated state. It should be noted, however, that it takes a huge cost to decrease the amounts of these materials to an extreme level while the material is in the molten steel state. For this reason, the upper range of the contents of these elements are set at 0.01 wt. %, under which the inhibition of the grain growth is negligible.

Al has a high solid-solubility against $\alpha$-iron, and a strong affinity to oxygen. Therefore, when the Goss texture is formed by the final heat treatment, Al reacts with a small amount of oxygen contained in the heat treatment atmosphere, to form an oxide layer on the surfaces of the steel sheet, thereby inhibiting the growth of crystal grains, which is supported by the surface energy. Thus, the Al content is limited to 0.01 wt. %, under which the above-mentioned problem can be avoided, and should more preferably be 0.005 wt. % or less. Al is added to materials usually as a deoxidizing agent, and therefore the amount of Al used should be particularly restricted. Here, it should be pointed out that the inventors of the present invention proposed for the first time the technical idea of enhancing the growth of Goss grains by finely controlling the amount of Al, which is a typical additive.

Cu has a low solid-solubility against $\alpha$-iron, and inhibits significantly the crystal grain growth during formation of the Goss texture by the final heat treatment. Further, the Cu content of the material in the steel refining process 0.05 wt. %, and should preferably be reduced to 0.01 wt. % or less, where the problem of the inhibition does not occur, and more preferably, 0.005 wt. % or less. Cu, the melting point of which is 1083° C., volatilizes in the heat treatment at a temperature of 1000° C. or higher, and therefore even if the Cu content is more than 0.01 wt. %, the content can be reduced to 0.01 wt. % or less by a long period of heat treatment. However, in terms of the efficiency of process, it is not appropriate to prolong the time period of the heat treatment.

Regarding the inevitable impurity elements other than those mentioned above, they can be neglected when the contents thereof are as much as those contained in general steel material. Of course, the smaller the contents of these impurity elements, the better the magnetic properties, and the like. For example, Sn, in particular, which has a poor solid-solubility against $\alpha$-iron, has the ability to inhibit the crystal grain growth during formation of the Goss texture by the final heat treatment, as in the case of Cu. Therefore, it is preferable that the Sn content be kept not more than 0.01 wt. %, more preferably 0.005% or less. Further, elements such as V and Zn, each of which has a high solid-solubility against $\alpha$-iron and a strong affinity to oxygen, each have the ability to inhibit the crystal grain growth supported by the surface energy as in the case of Al. Therefore, it is also preferable that the content of each of these elements be kept not more than 0.01 wt. %, more preferably 0.005 wt. %. Further, since oxygen in steel materials has an influence on the behavior of the tertiary recrystallization, the O content should be preferably be as low as possible, for example, 0.008 wt. % or less.

The rest, Mn and P also should be as small in amount as possible.

Steel materials satisfying the above-mentioned composition range can be molded from molten steel having such a composition range into ingot, or continuously molded into slab. The temperature of the ingot or slab is maintained 1000° C. or higher, and then they are subjected to the hot rolling. The reason for setting the temperature before the hot rolling 1000° C. or higher is that at such a high temperature, recrystallization during the hot rolling can be enhanced before the step of the roughing mill or the finishing mill, and the finishing temperature of 700° to 950° C. can be obtained at the end of the hot rolling. It should be noted that the hot rolling may be performed after heating the ingot or slab in a heating furnace up to 1000° C. or higher, or while, in the case of slab, maintaining the temperature after the continuous casting at 1000° C. by direct rolling.

The finishing temperature of the hot rolling need to be in the range between 700° to 950° C. If the finishing temperature is lower than 700° C., the load of the hot rolling will be too much to produce a good material, and also the growth of Goss grains, which takes place at the final stage, will be affected. On the other hand, if the finishing step temperature is higher than 950° C., the initial temperature of the ingot or slab need to be set higher than usual, thereby increasing the production cost.

Although depending on the thickness of a desired final product, the thickness of hot rolled sheets usually falls between a range of about 1.6 mm to 5.0 mm. The hot rolled sheets thus manufactured are coiled up by a general method, the coiling temperature should preferably be 560° to 800° C. If the coiling temperature is lower than 560° C., it is actually difficult to cool rolled sheets on the run-out table after the hot rolling is over, and therefore such a case is not suitable in a practical situation. On the other hand, if the coiling temperature is higher than 800° C., the surfaces of the sheet are oxidized, degrading the pickling performance, and therefore such a case is not practical, either.

If necessary, a hot band may be annealed by a continuous furnace or a batch furnace. This hot band annealing temperature should preferably be 700° to 1100° C. If the hot hand annealing temperature is lower than 700° C., the deformation texture formed while hot rolling cannot be vanished, and therefore the effect does not practically exhibit. On the other hand, if the hot-rolled sheet annealing temperature exceeds 1100° C., the operation cost will be high, and therefore the problem of high cost arises.

As mentioned before, a cold rolling step and annealing process are performed following the above.

In the first embodiment, the above-obtained hot-rolled sheet is subjected to the primary cold rolling using a general technique. Here, the cold rolling reduction is set at 30 to 85%. If the rolling reduction is lower than 30% or higher than 85%, a texture suitable for the growth of Goss grains, which are the result of the preferred crystal grain growth during the tertiary annealing step, cannot be formed, and therefore fully grown Goss grains cannot be obtained after the finishing (tertiary) annealing step. The cold rolling reduction optimum for obtaining a high magnetic flux density varies in accordance with a hot-rolled structure which also varies along with the finishing step temperature and the coiling step temperature for the hot-rolled sheet. For example, in the case where the finishing step temperature is low (about 750° C.), the rolling deformation texture is well developed by hot rolling, and therefore the rolling reduction of the primary rolling may be low. On the other hand, in the case where the finishing temperature is high (about 850° C.), the recrystallization texture is developed more than the deformation texture, and therefore the rolling reduction of the primary rolling is set high. Usually, a lubricating material is used in cold rolling, but even without the lubricating material, the same result can be obtained.

Then, the primary cold-rolled sheet is annealed (primary annealing) at a temperature of 600° to 900° C. If the annealing temperature is lower than 600° C., a perfect recrystallization cannot be achieved by the annealing, whereas the temperature which exceeds 900° C. achieves a perfect recrystallization, but the annealing cost will be inevitably high. In order to complete recrystallization in a short period of time in an economical way, the annealing should be performed at a temperature in the range of 680° to 800° C. Even if the surfaces of a steel sheet is somewhat oxidized during annealing of this type, the oxidized portion can be removed by pickling which is carried out before cold rolling. Consequently, such an oxidation is not a problem in terms of arrangement of crystals in the Goss orientation, during the tertiary annealing (the final annealing). Of course, since excess formation of an oxide layer is not appropriate, the annealing should preferably be performed in a non-oxidizing atmosphere in which the partial pressure of oxygen is extremely low, or in a vacuum atmosphere. Meanwhile, a time period of annealing is usually 2 minutes or more to be sufficient. This annealing process can be performed by batch annealing in a box-type furnace or by continuous annealing.

Regarding the heating conditions in the annealing process, the appropriate heating rate and keeping time of the continuous annealing, should be in the range of 200° to 500° C./min, and about 2 to 5 minutes, respectively, whereas those of the batch annealing should be 4° to 20° C./min, and 1 to 10 hours. The cooling rate may be one of those employed in general techniques, as long as the shape of the steel sheet is not distorted due to heat contraction. For example, up to 600° C., the cooling rate may be 13.5° C./sec, and up to 300° C., it may be 12° C./sec.

The steel. sheet which has been treated in the primary annealing, is subjected to the secondary cold rolling at a rolling reduction of 40 to 80%. If the rolling reduction is less than 40% or more than 80%, a sufficient Goss texture at the final stage can not be obtained for the reason stated in connection with the primary cold rolling. This cold rolling can be conducted with or without a lubricating material, as in the case of the primary cold rolling.

The secondary cold-rolled sheet is annealed again at a temperature of 600° to 900° C. (secondary annealing). If the annealing temperature is lower than 600° C., a perfect recrystallization cannot be achieved by the annealing, whereas the temperature which exceeds 900° C. achieves a perfect recrystallization, but the annealing cost will be inevitably high. In order to complete recrystallization in a short period of time in an economical way, the annealing should be performed at a temperature in the range of 680° to 800° C. As in the case of the primary annealing, some degree of oxidation of the surfaces of a steel sheet is not significant. However, since excess formation of an oxide layer is not desirable, the annealing should preferably be performed in a non-oxidizing atmosphere, in which the partial pressure of oxygen is extremely low, or in a vacuum atmosphere. Likewise, an annealing time period of 2 minutes or more is sufficient. This annealing process also can be performed by batch annealing in a box-type furnace or continuous annealing.

It should be noted that the magnetic flux density of the steel sheet after the tertiary annealing, which will be explained later, are influenced by the temperature of the aforementioned intermediate annealing performed after the primary and the secondary cold rolling processes. Consequently, the temperature of the primary and secondary annealing, as intermediate annealing, should be appropriately set.

Figure 2:
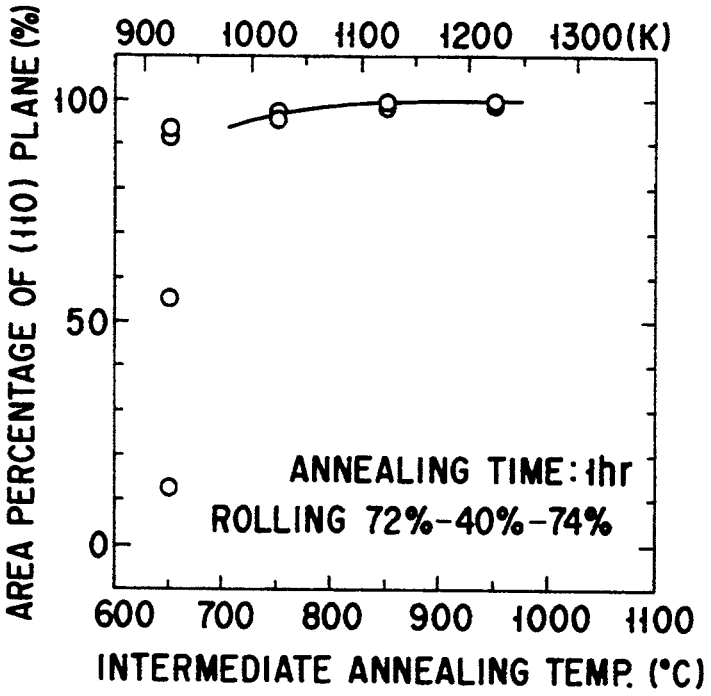
FIG. 2 is a graph showing the relationship between an intermediate annealing temperature and the occupying rate of a (110) plane in the sheet surface in the case where the primary, secondary, and tertiary rolling reductions are 72%, 40%, and 74%, respectively.
Figure 3:
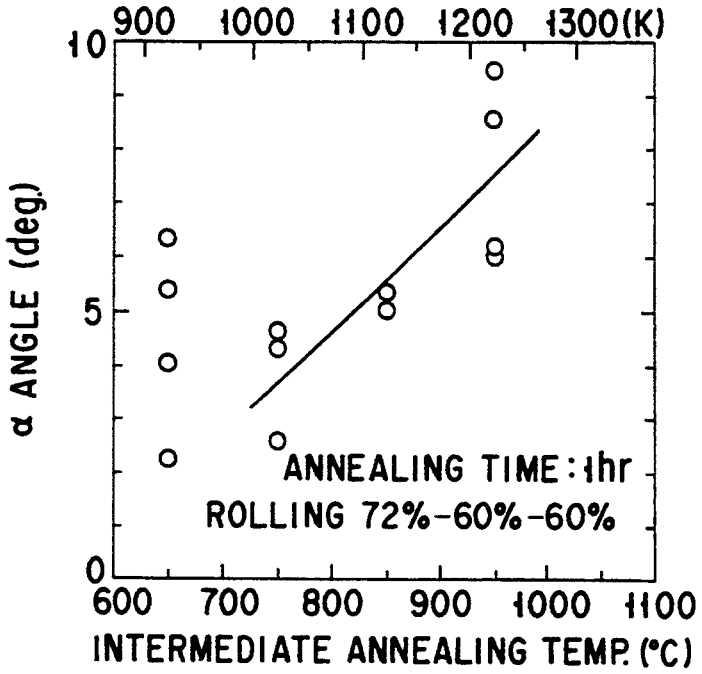
FIG. 3 is a graph showing the relationship between an intermediate annealing temperature and an angle $\alpha$ of the Goss texture in the case where the primary, secondary, and tertiary rolling reductions are 72%, 60%, and 60%, respectively.
Figure 4:
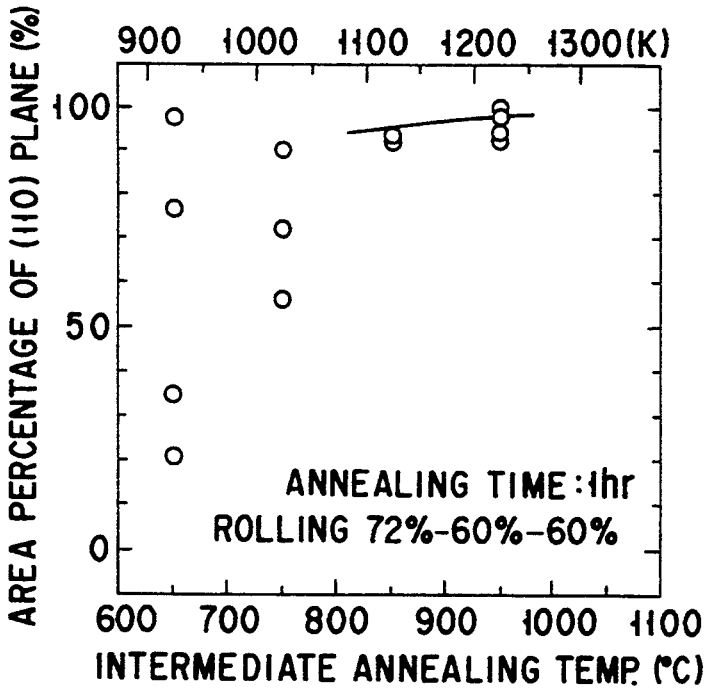
FIG. 4 is a graph showing the relationship between an intermediate annealing temperature and the occupying rate of a (110) plane in the sheet surface in the case where the primary, secondary, and tertiary rolling reductions are 72%, 60%, and 60%, respectively.

FIGS. 1–4 will be referred to describe the above-described points. FIG. 1 shows a relationship between an intermediate annealing temperature and an angle $\alpha$ of the Goss texture (angle made between the <001> axis of the sheet surface and the rolling direction) in the case where the primary, secondary, and tertiary rolling reductions are 72%, 40% and 74%, respectively. FIG. 2 shows a relationship between an intermediate annealing temperature and the occupying rate of the (110) plane within the sheet surface under the same rolling conditions as those of FIG. 1. FIGS. 3 and 4 show relationships corresponding to those of FIGS. 1 and 2, in the case where the primary, secondary, and tertiary rolling reductions are 72%, 60%, and 60%, respectively. An annealing time for each case is 1 hour.

As is clear from these figures, the growth rate of the (110) plane becomes higher, but the angle $\alpha$ becomes large as the annealing temperature is raised. On other hand, the angle $\alpha$ becomes smaller, but the growth rate of the (110) plane becomes lower as the annealing temperature is lowered. Thus, the magnetic flux density becomes small either the annealing temperature is too high or too low; therefore an appropriate temperature should be set.

The steel sheet which has been treated by the second annealing is subjected to the tertiary cold rolling process at a rolling reduction of 50 to 75%. If the rolling rate is lower than 50% or higher than 75%, a sufficient Goss texture cannot be obtained at the final stage for the reason stated in connection with the primary and secondary cold rolling steps. Likewise, the tertiary cold rolling also can be performed with or without a lubricating material.

The tertiary cold-rolled sheet thus obtained is further annealed at a temperature of 1000° to 1300° C. (tertiary annealing). During this step, crystal grains are grown by the surface energy, and thus Goss grains are grown. If the annealing temperature is less than 1000° C., the driving force for the crystal grain growth supported by the surface energy is not sufficient, and therefore a desired Goss texture cannot be obtained. On the other hand, the annealing temperature which exceeds 1300° C. requires too much cost, and therefore such a case is not practically appropriate.

The tertiary annealing should be performed in a reducing atmosphere containing an excessive amount of hydrogen, or in a non-oxidizing atmosphere mainly containing inert gases such as nitrogen, Ar, etc. and having an oxygen partial pressure of 0.5 Pa or less, or in a vacuum atmosphere wherein the partial pressure of oxygen is 0.5 Pa or less. The reason for carrying out the tertiary annealing in such an atmosphere is to prevent formation of an layer of oxides on the surfaces of a steel sheet, which disturbs the orientation of crystals in that of the Goss texture and the (100) crystals rather than the (110) crystals grow. In the case where oxygen is contained in a vacuum atmosphere or an inert gas atmosphere such that the partial pressure of oxygen exceeds 0.5 Pa, an layer of oxides is formed on the surfaces of the steel sheet, and the above-mentioned advantage cannot be obtained. A sufficient annealing time is 3 minutes or more, but the longer the annealing time, the more stable the Goss texture obtained.

In all the steel sheets obtained by the above techniques, Goss grains are stably grown. In the case of 3% Si steel, the magnetic properties are especially good, for example, the magnetic flux density $B_8$ in the case where a magnetic field of DC 800A/m is applied, is 1.8 T or higher.

The second embodiment will now be described.

As in a similar manner to that of the first embodiment, a hot-rolled sheet is subjected to the primary cold rolling by a general method. The rolling reduction of this cold rolling is set at 40% or higher. If the rolling reduction is lower than 40%, it is difficult to manufacture sheets having a final product sheet thickness (usually 1.0 mm or less) since the hot-rolled sheets are usually thick. Further, the effect of the surface energy becomes relatively small, and therefore a sufficient grain growth cannot be achieved in the annealing step which follows. Incidentally, although a lubricating material is usually employed in cold rolling, the same advantage can obtained even if rolling is carried out without a lubricating material.

The primary cold-rolled sheet thus obtained is annealed (primary annealing) at a temperature in the range of 600° to 900° C. If the annealing temperature is lower than 600° C., recrystallization cannot be perfected, whereas if the annealing temperature is higher than 900° C., the cost for the annealing is inevitably high, though the recrystallization can be perfected. In order to complete a perfect recrystallization economically in a short time period, the annealing should be conducted at a temperature in the range of 680° to 800° C. Since the degree of oxidation of the surfaces of a steel sheet by the annealing under such conditions is not so high, the oxidized surfaces can be removed by pickling which is carried out before the cold rolling, later performed. Therefore, orientation of grains in that of the Goss texture, which takes place during the secondary and tertiary annealing, will not be disturbed. Of course, since excess formation of an layer of oxides is not desirable, the annealing should be carried out in a non-oxidizing atmosphere wherein the oxygen partial pressure is kept as low as possible, or in a vacuum atmosphere. Meanwhile, a sufficient annealing time period is usually 2 minutes or more. This annealing process can be performed by batch annealing in a box-type further or by continuous annealing.

Regarding the heating conditions in the annealing process, the appropriate heating rate and keeping time of the continuous annealing, should be in the range of 200° to 500° C./min, and about 2–5 minutes, respectively, whereas those of the batch annealing should be 4°–20° C./min, and 1–10 hours. The cooling rate may be one of those employed in general techniques, as long as the shape of the steel sheet is not distorted due to heat contraction. For example, up to 600° C., the cooling rate may be 13.5° C./sec, and up to 300° C., it may be 12° C./sec.

The steel sheet which has been treated in the primary annealing, is subjected to the secondary cold rolling at a rolling reduction of 50 to 80%. If the rolling rate is less than 50% or more than 80%, a sufficient Goss texture at the final stage can not be obtained. This cold rolling can be conducted with or without a lubricating material, as in the case of the primary cold rolling.

The secondary cold-rolled sheet thus obtained is annealed again at a temperature of 1000° to 1300° C. (secondary annealing). If the annealing temperature is less than 1000° C., the driving force for the crystal grain growth supported by the surface energy is not sufficient, and therefore a desired Goss texture cannot be obtained. On the other hand, the annealing temperature which exceeds 1300° C. requires too much cost, and therefore is not economically practical.

The secondary annealing should be performed in a reducing atmosphere containing an excessive amount of hydrogen, or in a non-oxidizing atmosphere mainly containing inert gases such as nitrogen, Ar, etc. and having an oxygen partial pressure of 0.5 Pa or less, or in a vacuum atmosphere wherein the partial pressure of oxygen is 0.5 Pa or less. The reason for carrying out the tertiary annealing in such an atmosphere is to prevent formation of an layer of oxides on the surfaces of a steel sheet, which disturbs orientation of crystals in that of the Goss texture. In the case where oxygen is contained in a vacuum atmosphere or an inert gas atmosphere such that the partial pressure of oxygen exceeds 0.5 Pa, an layer of oxides is formed on the surfaces of the steel sheet, and the above-mentioned advantage cannot be obtained. A sufficient annealing time is 2 minutes or more as in the case of the primary annealing.

The secondary-annealed sheet this obtained, by itself, exhibits good properties including a high magnetic flux density ($B_8 \geqq 1.7$), and even better magnetic properties can be obtained by performing the tertiary cold rolling and tertiary annealing.

The rolling reduction of the tertiary cold rolling is set at 30% or higher. If the rolling reduction is less than 30%, the crystal structure obtained at the final stage cannot be formed into a desired Goss texture, whereas if it exceeds 50%, the magnetic flux density $B_8$ will be 1.9 T or higher. Incidentally, as in the cases of the primary and secondary cold rolling steps, this cold rolling can be carried out with or without a lubricating material.

The tertiary cold-rolled sheet thus obtained is annealed at a temperature of 1000° to 1300° C. (tertiary annealing). If the annealing temperature is less than 1000° C., the driving force for the crystal grain growth supported by the surface energy is not sufficient, and therefore a desired Goss texture cannot be obtained. On the other hand, the annealing temperature which exceeds 1300° C. requires too much cost, and therefore such a case is not economically practical. For the same reason stated in connection with the secondary annealing, this annealing also should be performed in a reducing atmosphere containing an excessive amount of hydrogen, or in a non-oxidizing atmosphere mainly containing inert gases such as nitrogen, Ar, etc. and having an oxygen partial pressure of 0.5 Pa or less, or in a vacuum atmosphere wherein the partial pressure of oxygen is 0.5 Pa or less. A sufficient annealing time is 3 minutes or more; however the longer the annealing time period, the more stable the Goss texture formed.

Steel sheets obtained by the above-described method each have stable Goss grains. Such steel sheets exhibit good magnetic properties, for example, the magnetic flux density $B_8$ when a magnetic field of DC 800A/m is applied is as good as 1.7 T or even better.

The third embodiment will now be explained.

In this embodiment, a hot-rolled sheet is subjected to the primary cold rolling by a general technique. The rolling reduction of this cold rolling is set at 40 to 80%. If the rolling reduction is lower than 40%, it is difficult to manufacture sheets having a final product sheet thickness (usually 1.0 mm or less) since the hot-rolled sheets are usually thick. Further, the effect of the surface energy becomes relatively small, and therefore a sufficient grain growth cannot be achieved in the annealing step which follows. On the other hand, if the rolling reduction is higher than 80%, Goss grains cannot be sufficiently grown, or there will be too much rolling load on the sheet.

In the case where the secondary cold rolling is carried out, it is not always necessary to set the lower range of the rate as above since the rolling reduction of the secondary cold rolling is high. However, even in the case where the secondary cold rolling is performed, the rolling reduction should preferably be 30% or higher, in order to obtain a certain degree of effect from the surface energy during the primary annealing.

Incidentally, although a lubricating material is usually employed in cold rolling, the same advantage can obtained even if rolling is carried out without a lubricating material.

The primary cold-rolled sheet thus obtained is annealed (primary annealing) at a temperature in the range of 1000° to 1300° C. If the annealing temperature is less than 1000° C., the driving force for the crystal grain growth supported by the surface energy is not sufficient, and therefore a desired Goss texture cannot be obtained. On the other hand, the annealing temperature which exceeds 1300° C. requires too much cost, and therefore such a case is not economically practical.

This annealing should be performed in a reducing atmosphere containing an excessive amount of hydrogen, or in a non-oxidizing atmosphere mainly containing inert gases such as nitrogen, At, etc. and having an oxygen partial pressure of 0.5 Pa or less, or in a vacuum atmosphere wherein the partial pressure of oxygen is 0.5 Pa or less. The reason for carrying out the tertiary annealing in such an atmosphere is to prevent formation of an layer of oxides on the surfaces of a steel sheet, which disturbs orientation of crystals in that of the Goss texture. In the case where oxygen is contained in a vacuum atmosphere or an inert gas atmosphere such that the partial pressure of oxygen exceeds 0.5 Pa, an oxidation film is formed on the surfaces of the steel sheet, and the above-mentioned advantage cannot be obtained. A sufficient annealing time is 3 minutes or more. This annealing process can be performed by batch annealing in a box-type furnace or by continuous annealing.

Regarding the heating conditions in the annealing process, the appropriate heating rate and keeping time of the continuous annealing, should be in the range of 200° to 500° C./min, and about 2 to 5 minutes, respectively, whereas those of the batch annealing should be 4° to 20° C./min, and 1 to 10 hours. The cooling rate may be one of those employed in general techniques, as long as the shape of the steel sheet is not distorted due to heat contraction. For example, up to 600° C., the cooling rate may be 13.5° C./sec, and up to 300° C., it may be 12° C./sec.

The annealed sheet thus obtained, by itself, has a good Goss texture, and exhibits a high magnetic flux density, and even more stable Goss texture and better magnetic properties can be obtained by performing the secondary cold rolling and secondary annealing.

The rolling reduction of the secondary cold rolling is set at 90% or higher. If the rolling reduction is less than 90%, a sufficient Goss texture cannot be obtained at the final stage. Incidentally, as in the case of the primary step, this cold annealing can be carried out with or without a lubricating material.

The secondary cold-rolled sheet thus obtained is annealed at a temperature of 1000° to 1300° C. (secondary annealing). If the annealing temperature is less than 1000° C., the driving force for the crystal grain growth supported by the surface energy is not sufficient, and therefore a desired Goss texture cannot be obtained. On the other hand, the annealing temperature which exceeds 1300° C. requires too much cost, and therefore such a case is not economically practical. For the same reason stated in connection with the primary annealing, this annealing also should be performed in a reducing atmosphere, or in a non-oxidizing atmosphere having an oxygen partial pressure of 0.5 Pa or less, or in a vacuum atmosphere wherein the partial pressure of oxygen is 0.5

Pa or less. As described before, formation of an layer of oxides on the surfaces of the sheet disturbs the grain growth, and a desired Goss texture cannot be obtained at the final stage. A sufficient annealing time is 3 minutes or more as in the primary annealing.

The steel sheets obtained by the above method, each have Goss textures, with a high precision, i.e. displacement with respect to the rolling direction of the <001> axis is no more than 5°. Regarding the magnetic properties of each of the sheets, for example, the magnetic flux density $B_8$ in the case where a magnetic field of DC 800A/m is applied, will be as high as 1.6 or higher. Especially, when the cold rolling reduction at the final stage is increased up to about 95%, the magnetic flux density $B_8$ will be as extremely high as 1.96 T.

As described, steel sheets having good properties can be obtained by the above-described methods according to the invention, and the reason that such steel sheets can be obtained by each method is supposed to be as follows:

In the case of the first embodiment, a steel material having a particular composition is subjected to the primary cold rolling, the primary annealing, the secondary cold rolling, the secondary annealing, and the tertiary cold rolling, under particular conditions, and thus a preferable texture is formed. Further, the tertiary annealing, in which the crystal grain growth occurs utilizing the surface energy, is carried out, and thus the grain growth occurs selectively for Goss grains. If the conditions under each of which the primary cold rolling, the primary annealing, the secondary cold rolling, the secondary annealing, and the tertiary cold rolling are performed, do not satisfy those defined in the present invention, desired large crystals cannot be obtained at the final stage, or the precision of arrangement of the crystals in the Goss orientation will be insufficient (the (110) plane is aligned with the sheet surface, but the <001> axis is displaced from the rolling direction) no matter how strictly the conditions of the tertiary annealing are satisfied.

In the case of the second embodiment, a steel material having a particular composition is subjected to the primary cold rolling, the primary annealing, and then the secondary cold rolling, or subjected to the primary cold rolling, the primary annealing, the second cold rolling, the secondary annealing, and the tertiary cold rolling, so as to form a preferable texture. Further, the secondary or tertiary annealing, in which the crystal grain growth occurs utilizing the surface energy, is carried out, and thus the grain growth proceeds selectively for Goss grains.

In the case of the third embodiment, a steel material having a particular composition is subjected to the primary cold rolling, and thereafter the primary annealing is carried out. During the primary annealing, the grain growth proceeds selectively in a preferable crystal orientation, due to the surface energy. Further, the secondary cold rolling is carried out at a high rolling reduction to form more preferable texture, and during the second annealing, which follows the rolling process, the crystal grain growth further proceeds by utilizing the surface energy. Thus, the selective growth for Goss grains are achieved.

EXAMPLES

Example 1

A steel material having the chemical composition shown in Table 1 was made into ingots, and then each of the ingots was hot-rolled into a sheet under the conditions, i.e. the finishing temperature: 750° C., the coiling temperature: 600° C., and the thickness of finished sheet: 1.8 mm. Inhomogeneities of deformation and recrystallizaiton in the rolled specimens were observed on the longitudinal section by optical microscopy. According to structure analysis of the steel sheet, fine recrystallized grains were formed on the surface area, and a elongated deformation grains in the inner area (center portion).

TABLE 1

| Content (wt %) | | | | | | | | | |
|---|---|---|---|---|---|---|---|---|---|
| C | Si | Mn | P | S | Sol.Al | N | Cu | Mo | O |
| 0.005 | 3.02 | 0.01 | 0.004 | 0.002 | 0.004 | 0.0015 | <0.01 | <0.01 | 0.0017 |

Thus obtained hot-rolled sheet was pickled to remove the layer of oxides formed on the surface area, and subjected to the primary cold rolling at a rolling rate of 39 to 78%. Then, the steel sheet was subjected to the primary annealing at 700° C. for 1 hour in a 100% nitrogen atmosphere.

Each steel sheet thus annealed was subjected to the second cold rolling at a rolling reduction varied from 38% to 82%, and then subjected to the second annealing under the same conditions as those for the primary annealing.

Each secondary-annealed steel sheet was then subjected to the tertiary cold rolling at a rolling reduction varied from 50% to 80% such tha% the sheet at the end of this process have a thickness of 0.10 mm, and Each steel sheet was further subjected to the tertiary annealing in a reducing atmosphere (100% hydrogen) or a vacuum atmosphere wherein the oxygen partial pressure is 0.5 Pa or lower, at a temperature in the range of 900 to 1300° C.

Figure 5:
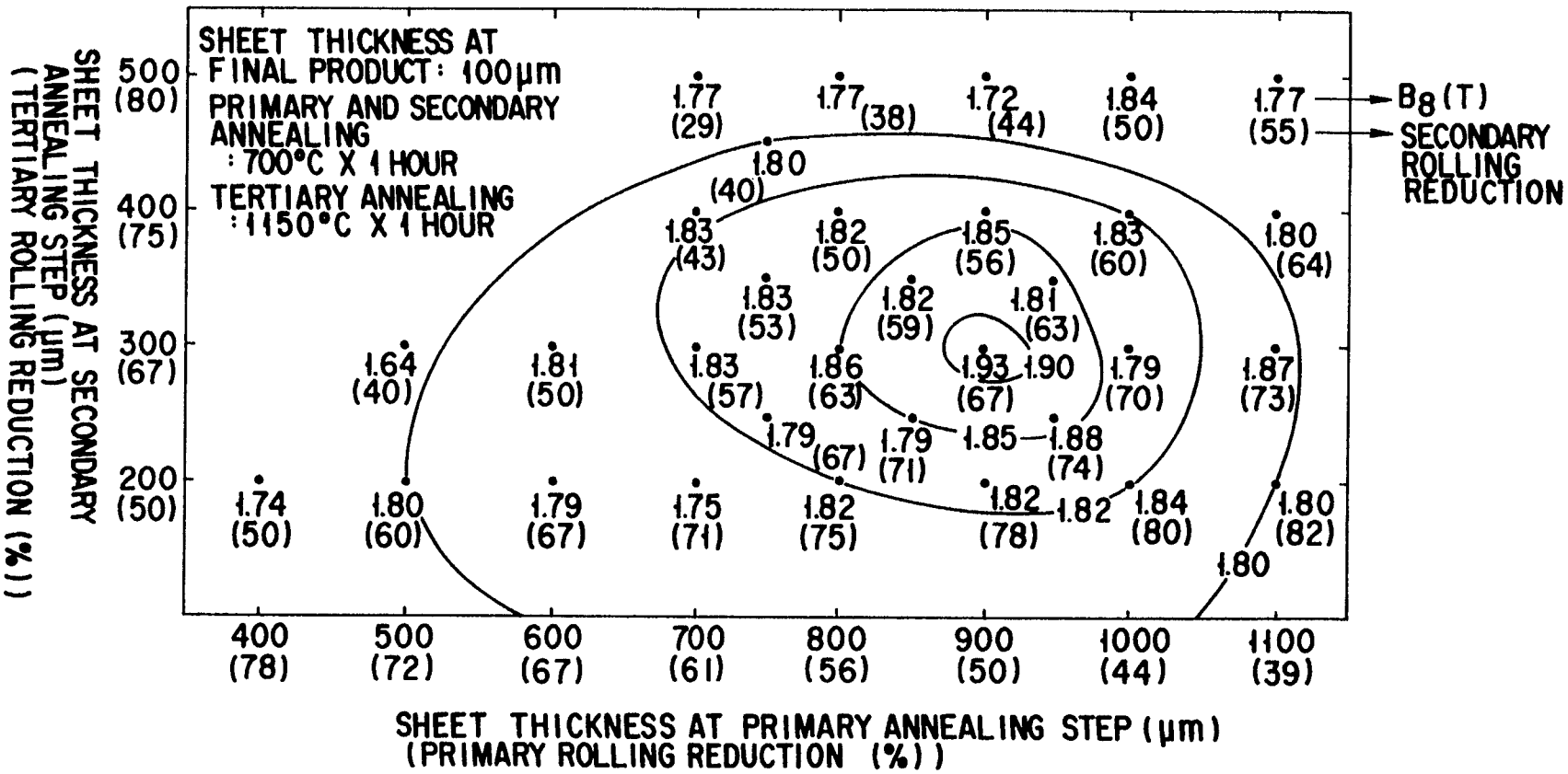
FIG. 5 is a graph showing the relationship between the rolling reduction of each rolling process, or the thickness of a sheet during an intermediate annealing, and the magnetic flux density $B_8$ of a steel sheet after the tertiary annealing, according to the Example 1.
Figure 6:
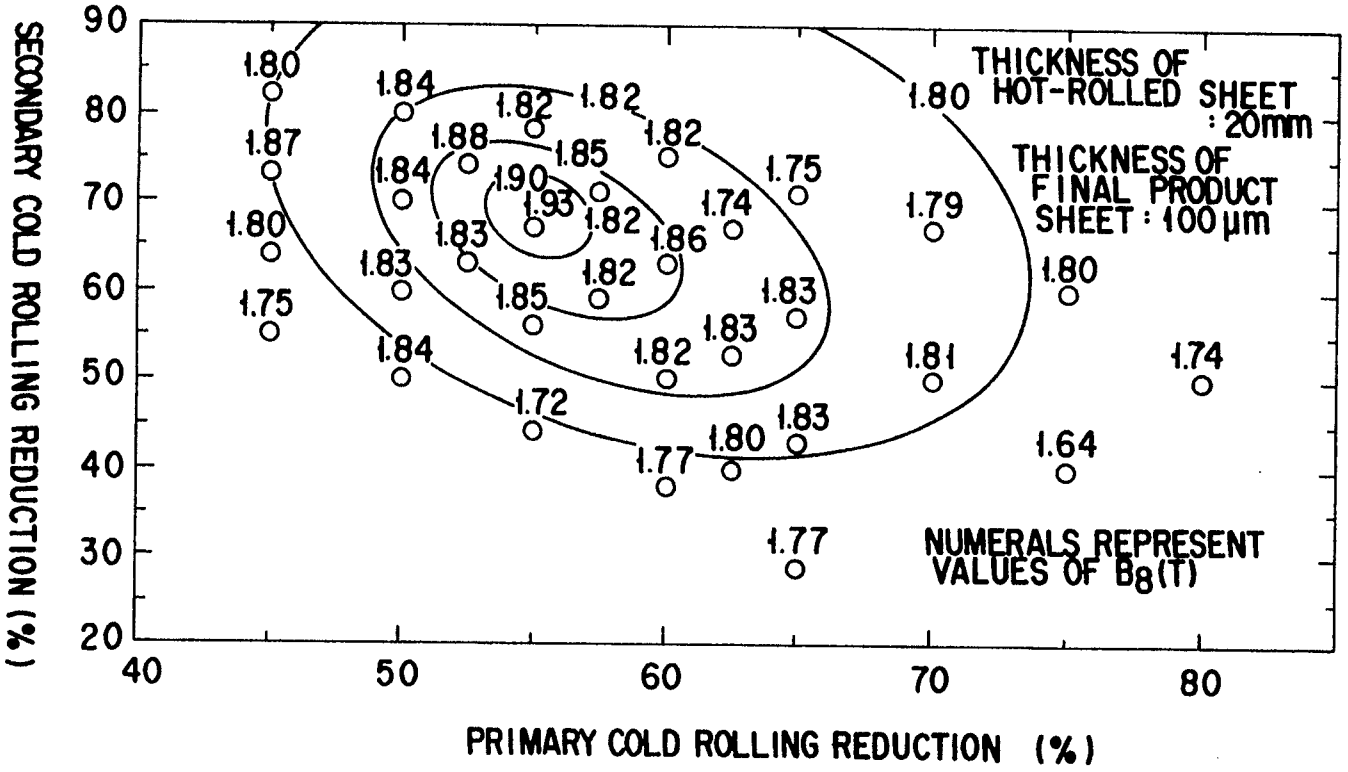
FIG. 6 is a graph showing the magnetic flux density $B_8$ of a steel sheet after the tertiary annealing in the case where the primary and secondary rolling reductions are variously changed, according to the Example 1.

During the tertiary annealing, all the surface of each sheet was covered with coarse grains at a temperature of 1100° C. or higher in the case of the reducing atmosphere, whereas at a temperature of 1000° C. or higher in the case of the vacuum atmosphere. An etch pit observation showed that the coarse grains were all <110>/N.D. Of all the sheets thus obtained, those which were tertiary-annealed at a temperature of 1150° C. in a vacuum atmosphere wherein the oxygen partial pressure of 0.5 Pa for 1 hour was measured with regard to magnetic flux density $B_8$ by use of a DC BH-loop tracer. The shape of the sample for the measurement was rectangular, $10\times100$ mm$^2$. The results were shown in FIGS. 5 and 6. FIG. 5 illustrates the relationship between a rolling reduction of each rolling process or a thickness of a sheet during an intermediate annealing, and a magnetic flux density $B_8$ of the steel sheet after the tertiary annealing. Meanwhile, FIG. 6 shows values of magnetic flux density $B_8$ of steel sheets after the tertiary annealing at various rolling reductions in the primary and secondary rolling steps.

It is clear from these figures that a steel sheet having good properties including $B_8 \geqq 1.82$ T can be obtained by setting the primary cold rolling reduction in the range of 40 to 61%, the secondary cold rolling reduction in the range of 43 to 80%, and the tertiary cold rolling rate in 50 to 75%. Further, it can be understood from the figures that even better properties including $B_8 \geqq 1.85$ T can be achieved by setting the primary cold rolling rate in the range of 45 to 56%, the secondary cold rolling reduction in the range of 56–74%, and the tertiary cold rolling reduction in 60 to 75%.

Example 2

A steel material having the chemical composition shown in Table 2 was made into ingots, and then each of the ingots was hot-rolled into a sheet under the conditions, i.e. the finishing temperature: 850° C., the winding temperature: 700° C., and the thickness of finished sheet: 2.5 mm.

TABLE 2

| Content (wt %) | | | | | | | | | |
|---|---|---|---|---|---|---|---|---|---|
| C | Si | Mn | P | S | Sol.Al | N | Cu | Mo | O |
| 0.004 | 6.62 | 0.02 | 0.005 | 0.002 | 0.004 | 0.0017 | <0.01 | <0.01 | 0.0010 |

Thus obtained hot-rolled sheet was pickled to remove the layer of oxides formed on the surface area, and subjected to the primary cold rolling at a rolling rate of 56 to 84%. Then, the steel sheet was subjected to the primary annealing at 700° C. for 1 hour in a 100% nitrogen atmosphere.

Each steel sheet thus annealed was subjected to the second cold rolling at a rolling reduction varied from 38% to 82%, and then subjected to the second annealing under the same conditions as those for the primary annealing.

Each secondary-annealed steel sheet was then subjected to the tertiary cold rolling at a rolling reduction varied from 25% to 70% such that sheet at the end of this process had a thickness of 0.15 mm, and each steel sheet was further subjected to the tertiary annealing in a reducing atmosphere (100% hydrogen) or a vacuum atmosphere wherein the oxygen partial pressure is 0.5 Pa or lower, at a temperature in the range of 900° to 1300° C.

Figure 7:
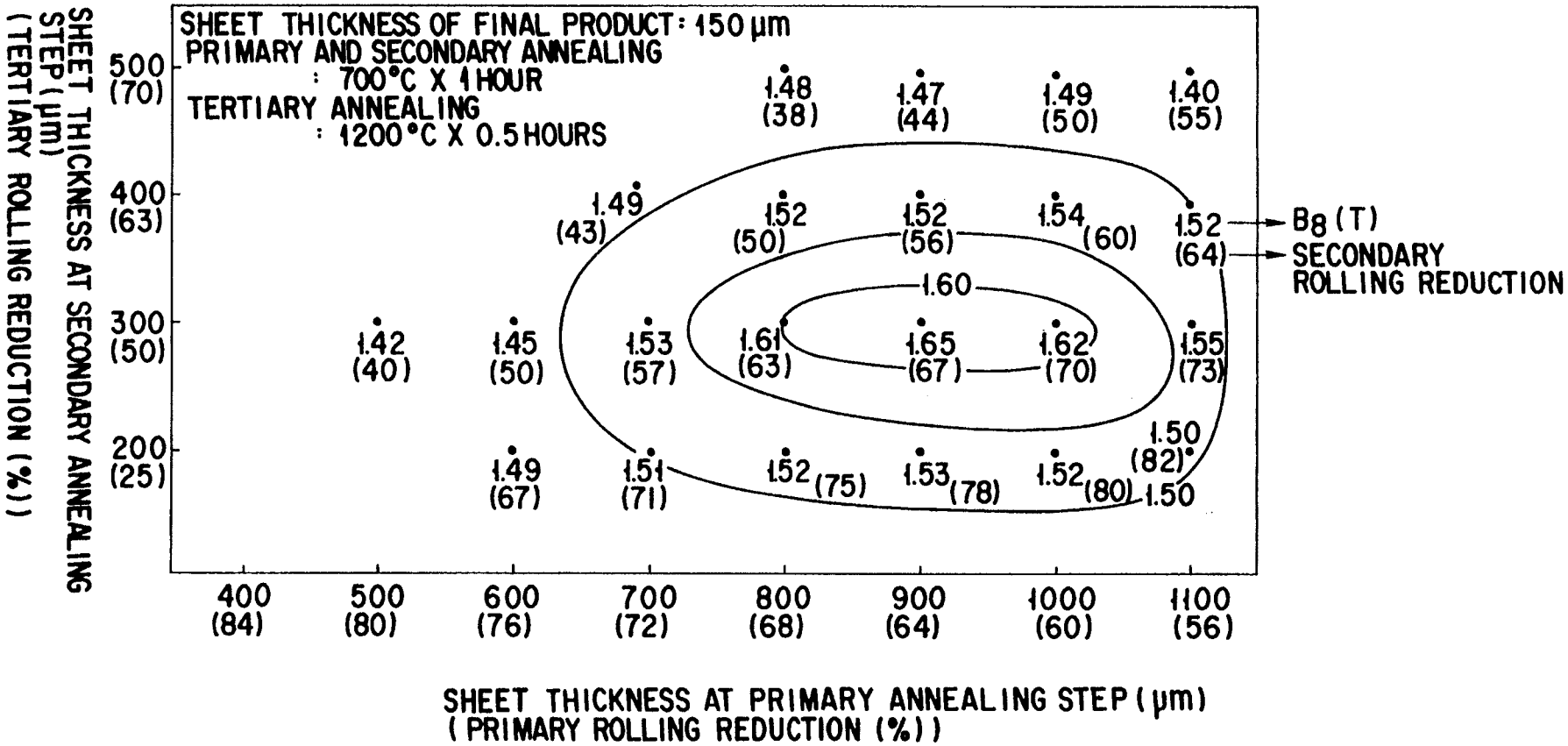
FIG. 7 is a graph showing the relationship between the rolling reduction of each rolling process, or the thickness of a sheet obtained by the intermediate annealing, and the magnetic flux density $B_8$ of a steel sheet after the tertiary annealing, according to the Example 2.
Figure 8:
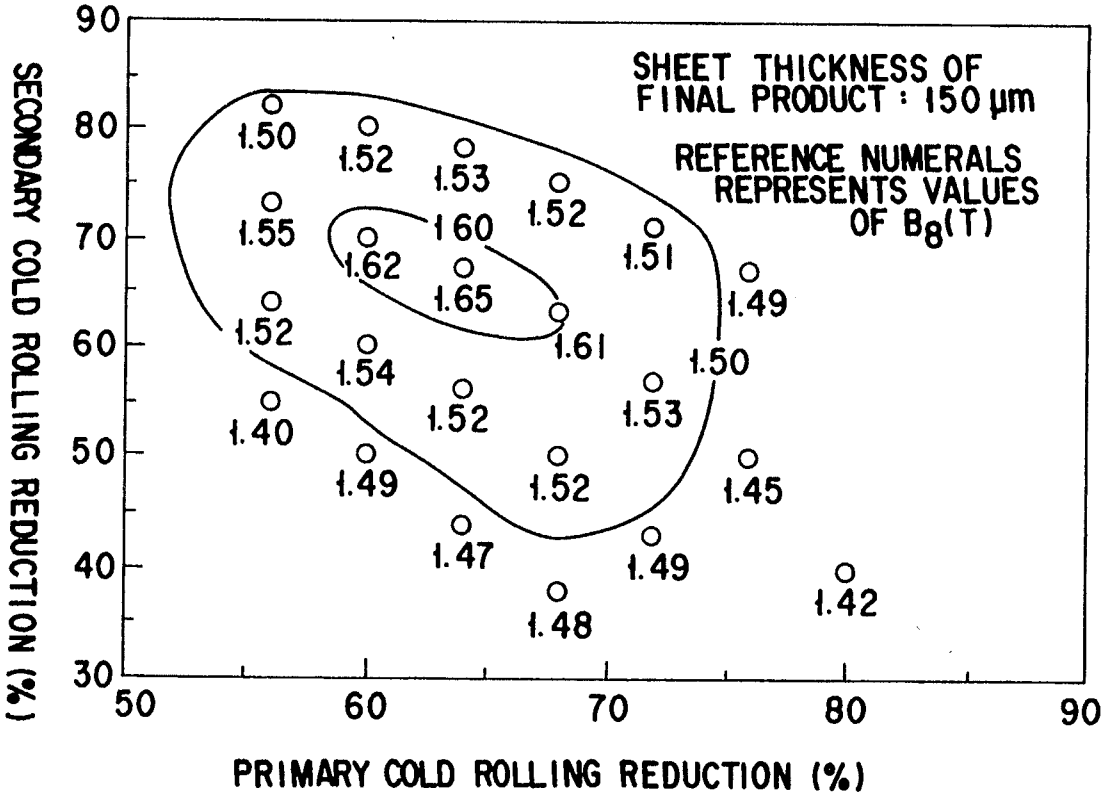
FIG. 8 is a graph showing the magnetic flux density $B_8$ of a steel sheet after the tertiary annealing in the case where the primary and secondary rolling reductions are variously changed, according to the Example 2.

During the tertiary annealing, all the surface of each sheet was covered with coarse grains at a temperature of 1050° C. or higher in the case of the reducing atmosphere, whereas at a temperature of 1000° C. or higher in the case of the vacuum atmosphere. Of all the sheets thus obtained, those which were tertiary-annealed at a temperature of 1200° C. in the reducing atmosphere for 30 minutes was measured with regard to magnetic flux density $B_8$ by use of a DC BH-loop tracer. The shape of the sample was the same as that of example 1. The results were shown in FIGS. 7 and 8, which correspond to FIGS. 5 and 6, respectively. Similarly, FIG. 7 illustrates the relationship between a rolling rate of each rolling process or a thickness of a sheet during an intermediate annealing, and a magnetic flux density $B_8$ of the steel sheet after the terriamy annealing, where as FIG. 8 shows values of magnetic flux density $B_8$ of steel sheets after the tertiary annealing at various rolling reductions in the primary and secondary rolling steps.

It is clear from these figures that a steel sheet having good properties including $B_8 \geqq 1.60$ T can be obtained by setting the primary cold rolling reduction in the range of 60 to 70%, the secondary cold rolling reduction in the range of 60 to 70%, and the tertiary cold rolling rate in 64 to 70%.

Example 3

Figure 9:
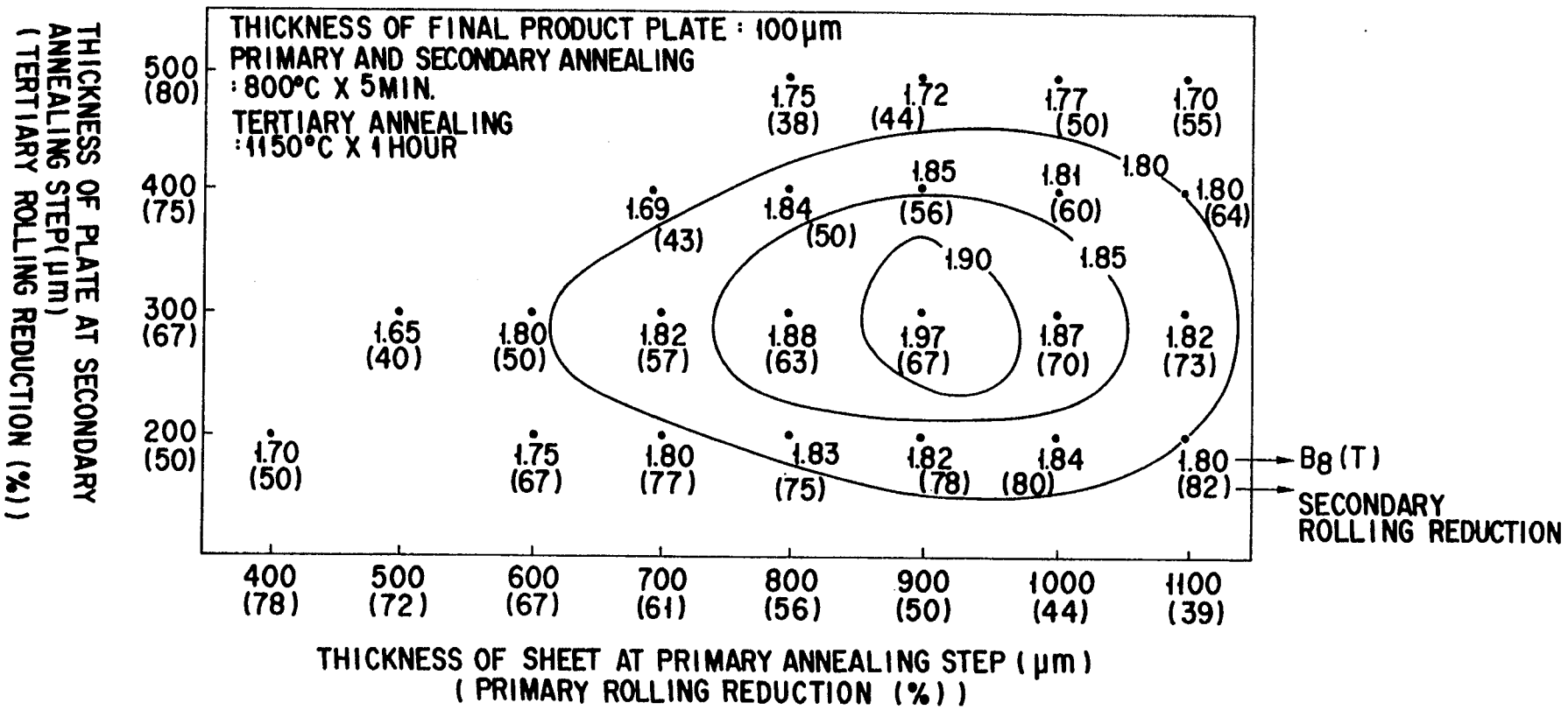
FIG. 9 is a graph showing the relationship between the rolling reduction of each rolling process, or the thickness of a sheet obtained by the intermediate annealing, and the magnetic flux density $B_8$ of a steel sheet after the tertiary annealing, according to the Example 3.
Figure 10:
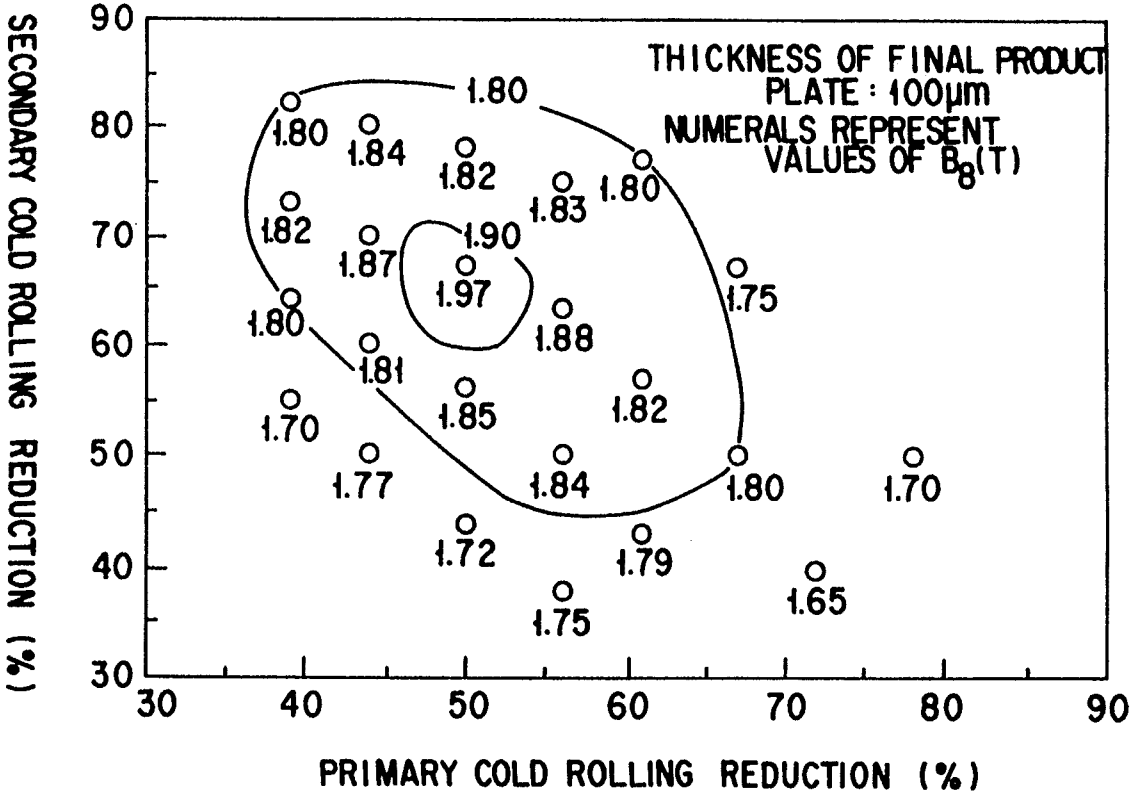
FIG. 10 is a graph showing the magnetic flux density $B_8$ of a steel sheet obtained by the tertiary annealing in the case where the primary and secondary rolling reductions are variously changed, according to the Example 3.

Steel sheets were formed in the same procedure as the example 1 except that the primary and secondary annealing steps are carried out in a continuous manner of 800° C.×5 minutes, and the tertiary annealing of 1150° C.×1 hour. The sheets thus obtained were measured with regard to magnetic flux density $B_8$ by use of a DC BH-loop tracer. The shape of the sample was the same as that of example 1. The results were shown in FIG. 9 which correspond to FIGS. 5 or 7, and FIG. 10 corresponding to FIG. 6 or 8. Similarly, FIG. 9 illustrates the relationship between a rolling reduction of each rolling process or a thickness of a sheet during an intermediate annealing, and a magnetic flux density $B_8$ of the steel sheet after the tertiary annealing, whereas FIG. 10 shows values of magnetic flux density $B_8$ of steel sheets after the tertiary annealing at various rolling reductions in the primary and secondary rolling steps.

It is clear from these figures that a steel sheet having good properties including $B_8 \geqq 1.80$ T can be obtained by setting the primary cold rolling reduction in the range of 39 to 67%, the secondary cold rolling reduction in the range of 50 to 80%, and the tertiary cold rolling rate in 50 to 75%. Further, it can be understood from the figures that even better properties including $B_8 \geqq 1.85$ T can be achieved by setting the primary cold rolling reduction in the range of 45 to 56%, the secondary cold rolling reduction in the range of 56 to 70%, and the tertiary cold rolling reduction in 50 to 75%.

Example 4

A steel material having the chemical composition shown in Table 1 was made into ingots, and then each of the ingots was hot-rolled into a sheet under the conditions, i.e. the finishing temperature: 830° C., the winding temperature: 610° C., and the thickness of finished sheet: 2.2 mm. Thus obtained hot-rolled sheet was pickled to remove the layer of oxides formed on the surface area, and subjected to the primary cold rolling at a rolling reduction of 40 to 78%. Then, the steel sheet was subjected to the primary annealing at 750° C. for 1 hour.

Each steel sheet thus annealed was subjected to the second cold rolling at a rolling reduction varied from 20% to 82%, and then subjected to the second annealing under the same conditions as those for the primary annealing.

Figure 11:
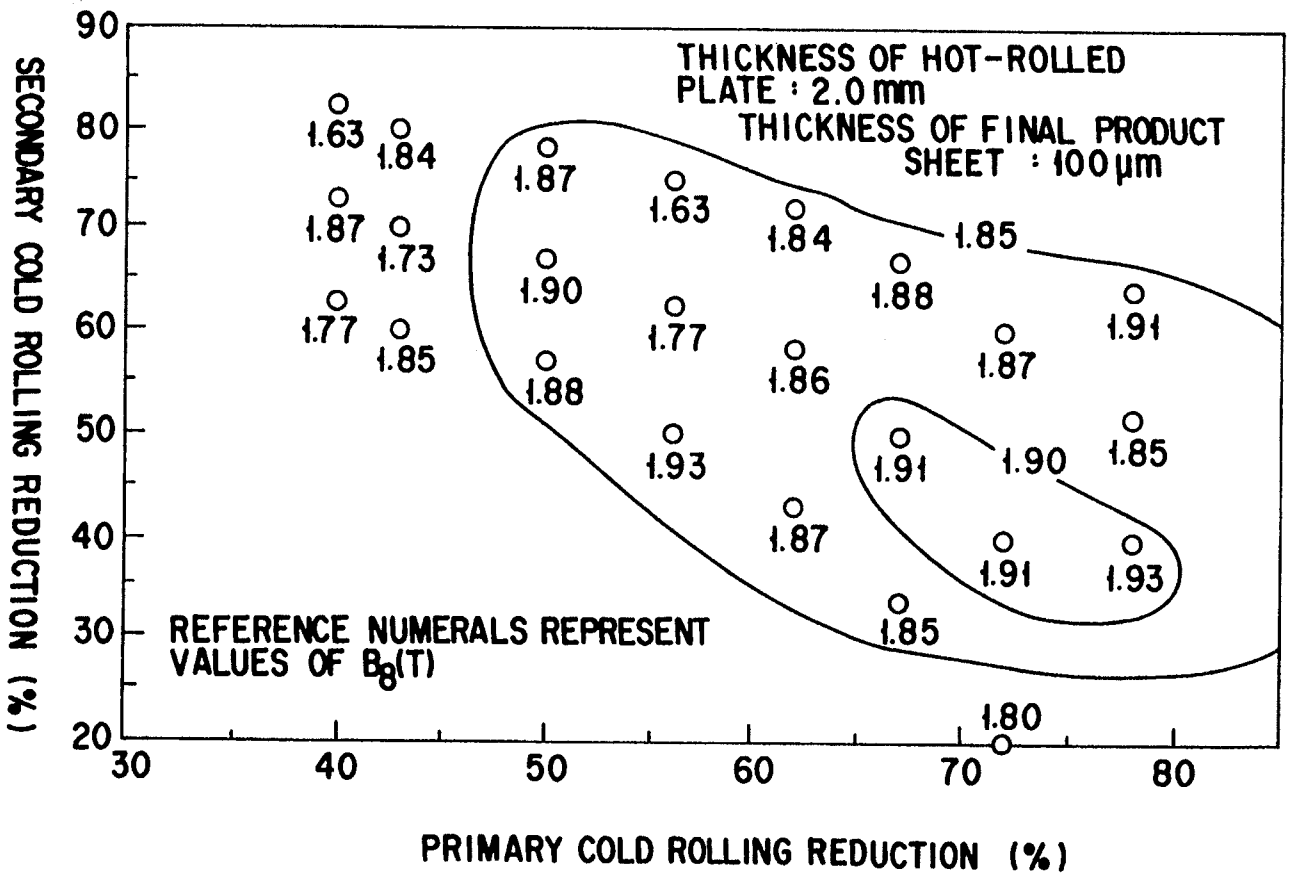
FIG. 11 is a graph showing the magnetic flux density $B_8$ of a steel sheet obtained by the tertiary annealing in the case where the primary and secondary rolling reductions are variously changed, according to the Example 4.

Each secondary-annealed steel sheet was then subjected to the tertiary cold rolling at a rolling reduction varied from 50% to 80% such that the sheet at the end of this process had a thickness of 0.10 mm, and each steel sheet was further subjected to the tertiary annealing in a vacuum atmosphere wherein the oxygen partial pressure is 0.5 Pa or lower at a temperature of 1150° C. for 1 hour. The sheets thus obtained were measured with regard to magnetic flux density $B_8$ by use of a DC BH-loop tracer. The shape of the sample was the same as that of example 1. The results were shown in FIG. 11, which correspond to FIG. 6, 8, or 10. Similarly, FIG. 11 shows values of magnetic flux density $B_8$ of steel sheets after the tertiary annealing at various rolling rates in the primary and secondary rolling steps.

It is clear from the comparison with FIG. 6 of the example 1 that the optimum range of the primary rolling rate is shifted to a level higher than that of the example 1, proportional to the increase in the finishing step temperature of the hot rolling.

Example 5

Steel materials A1 to B3 having the chemical compositions shown in Table 3 were made into ingots, and then each of the ingots was hot-rolled into a sheet under the conditions, i.e. the finishing temperature: 800° C., the winding temperature: 610° C., and the thickness of finished sheet: 2.4 mm.

TABLE 3

| type of steel | Content (wt %) | | | | | | | | |
|---|---|---|---|---|---|---|---|---|---|
| | C | Si | Mn | P | S | Sol.Al | N | Cu | Sn |
| A1 | 0.0024 | 3.02 | 0.06 | 0.004 | 0.002 | 0.003 | 0.0026 | 0.002 | <0.001 |
| A2 | 0.0025 | 3.02 | 0.06 | 0.004 | 0.002 | 0.003 | 0.0026 | 0.008 | 0.002 |
| A3 | 0.0024 | 3.02 | 0.06 | 0.004 | 0.002 | 0.003 | 0.0026 | 0.050 | 0 004 |
| B1 | 0.0024 | 3.02 | 0.06 | 0.004 | 0.002 | 0.003 | 0.0026 | 0.002 | <0.001 |
| B2 | 0.0024 | 3.02 | 0.06 | 0.004 | 0.002 | 0.008 | 0.0026 | 0.002 | <0.001 |
| B3 | 0.0024 | 3.02 | 0.06 | 0.004 | 0.002 | 0.085 | 0.0026 | 0.002 | <0.001 |

Each of thus obtained hot-rolled sheets was pickled to remove the layer of oxides formed on the surface area, and subjected to the primary cold rolling at a rolling rate of 79%. Then, the steel sheet was subjected to the primary annealing at 900° C. for 3 minutes. The primary annealing was carried out in a continuous manner in an atmosphere consisting of 40% of hydrogen and 60% of nitrogen, and the dew point temperature of which is −30° C.

Each steel sheet thus annealed was subjected to the second cold rolling at a rolling reduction of 40%, and then subjected to the second annealing under the same conditions as those for the primary annealing.

Each secondary-annealed steel sheet was then subjected to the tertiary cold rolling such that the sheet at the end of this process had a thickness of 0.10 mm, and each steel sheet was further subjected to the tertiary annealing in a hydrogen atmosphere wherein the oxygen partial pressure is 0.5 Pa or lower, at a temperature of 1180° C. for 5 hours. The sheets thus obtained were measured with regard to magnetic flux density $B_8$ by use of a DC BH-loop tracer. The shape of the sample was the same as that of example 1. The results were shown in Table 4 below. It should be noted that the steel materials A1 to A3 each have different Cu contents, and the materials B1 to B3 each have different Al contents.

TABLE 4

| Type of steel | Conditions of tertiary annealing | |
|---|---|---|
| | 1180° C. × 1 hour magnetic flux density $B_8$ (T) | 1180° C. × 5 hours magnetic flux density $B_8$ (T) |
| A1 | 1.93 | 1.94 |
| A2 | 1.85 | 1.93 |
| A3 | 1.76 | 1.77 |
| B1 | 1.91 | 1.93 |
| B2 | 1.86 | 1.90 |
| B3 | 1.65 | 1.68 |

As is clear from Table 4, a high magnetic flux density can be obtained in the case where Cu or Al content is 0.01 wt. % or less. It was further confirmed that the magnetic flux density tends to be higher as the time period for the heat treatment becomes longer.

Example 6

A steel material having the chemical composition shown in Table 1 were made into ingots, and then each of the ingots was hot-rolled into a sheet under the conditions, i.e. the finishing temperature: 780° C., the winding temperature: 610° C., and the thickness of finished sheet: 2.3 mm. Each of thus obtained hot-rolled sheets was pickled to remove the layer of oxides formed on the surface area, and subjected to the primary cold rolling at a rolling reduction of 69.5%. Then, the steel sheet was subjected to the primary annealing at 800° C. for 2 minutes in a continuous annealing furnace.

Each steel sheet thus annealed was subjected to the second cold rolling at a rolling reduction of 57%, and then subjected to the second annealing under the same conditions as those for the primary annealing.

Figure 12:
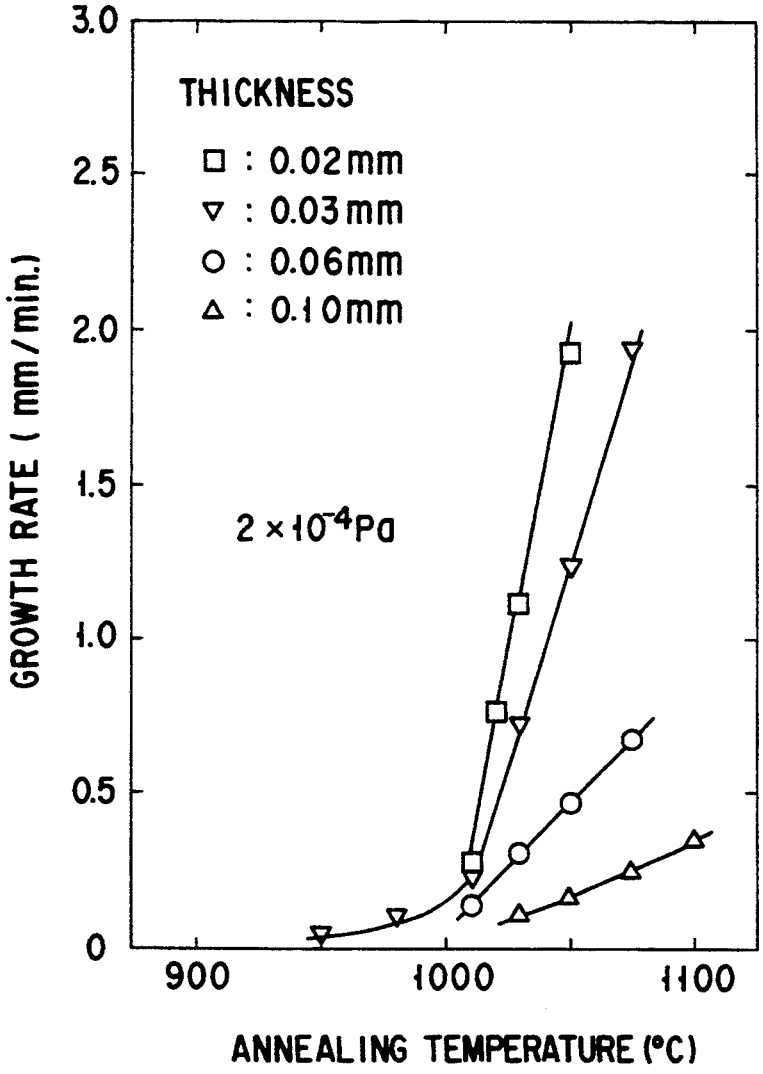
FIG. 12 is a graph showing the growth speed of the Goss grains formed on each of the sheets having the thicknesses of the final stage during the tertiary recrystallization.

Each secondary-annealed steel sheet was then subjected to the tertiary cold rolling to prepare steel sheets each having thickness of 0.10, 0.06, 0.03 and 0 0.02 mm at the end of this process, and each steel sheet was further subjected to the tertiary annealing in a vacuum atmosphere wherein the oxygen partial pressure is 0.5 Pa or lower, at a temperature in the range of 950° to 1100° C. for 1 hour. FIG. 12 shows the growth rate of Goss grains created by the tertiary recrystallization taking place on each sheet at the final stage.

As is clear from FIG. 12, it was confirmed that the thinner the sheet of the final product, the lower the temperature at which Goss grains start to grow, and the higher the growth rate.

Example 7

A steel material having the chemical composition shown in Table 1 were made into ingots, and then each of the ingots was hot-rolled into a sheet under the conditions, i.e. the finishing temperature: 820° C., the winding temperature: 600° C., and the thickness of finished sheet: 1.8 mm. Each of thus obtained hot-rolled sheets each having a thickness of 1.8 mm was pickled to remove the layer of oxides formed on the surface area, and subjected to the primary cold rolling at a rolling rate in the range from 40% (at which the sheet had a thickness of 1 mm) to 85% (at which the sheet had a thickness of 0.3 mm). Then, the steel sheet was subjected to the primary annealing at a temperature in the range of 600° to 900° C. for 1 hour in a non-oxidation atmosphere.

Figure 13:
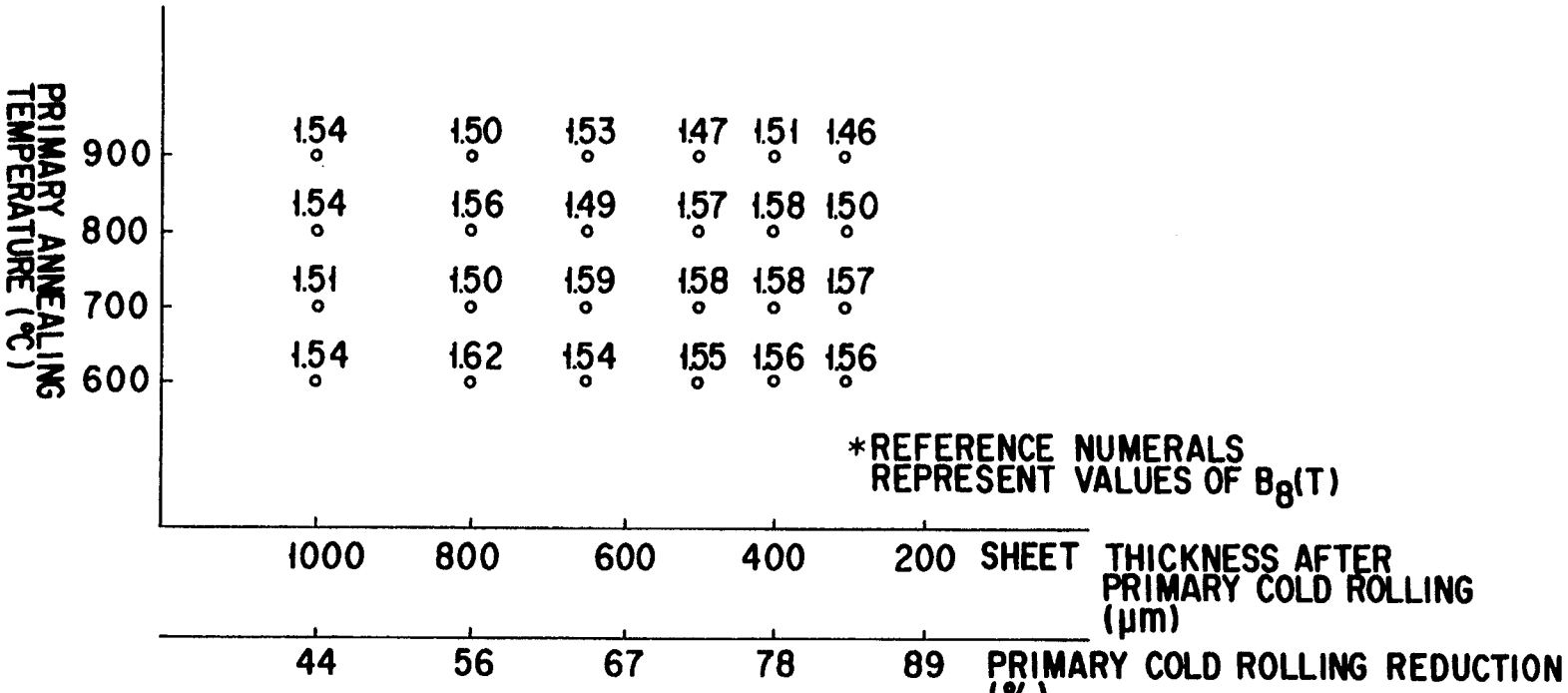
FIG. 13 is a graph showing the DC magnetic properties of steel sheets obtained by the primary annealing, according to the Example 7.

FIG. 13 is designed to illustrate DC magnetic properties (in terms of magnetic flux density $B_8$) of each steel sheet at this stage, and shows values of $B_8$ for various primary cold rolling reductions and primary annealing temperatures. As can be seen in this figure, no sheets prepared by the above-describe procedure exhibited a magnetic flux density $B_8$ higher than 1.6 T, and therefore good magnetic properties were not obtained at this stage.

Each steel sheet thus obtained was subjected to the secondary cold rolling until the sheet had a thickness of 0.1 mm. The cold rolling reduction here was about 60 to 90%. Each steel sheet was further subjected to the secondary annealing in a vacuum atmosphere wherein the oxygen partial pressure was 0.5 Pa or lower, at a temperature of 1200° C. for 5 hours. Each steel sheet obtained after the annealing was measured with regard to the DC magnetic properties.

Figure 14:
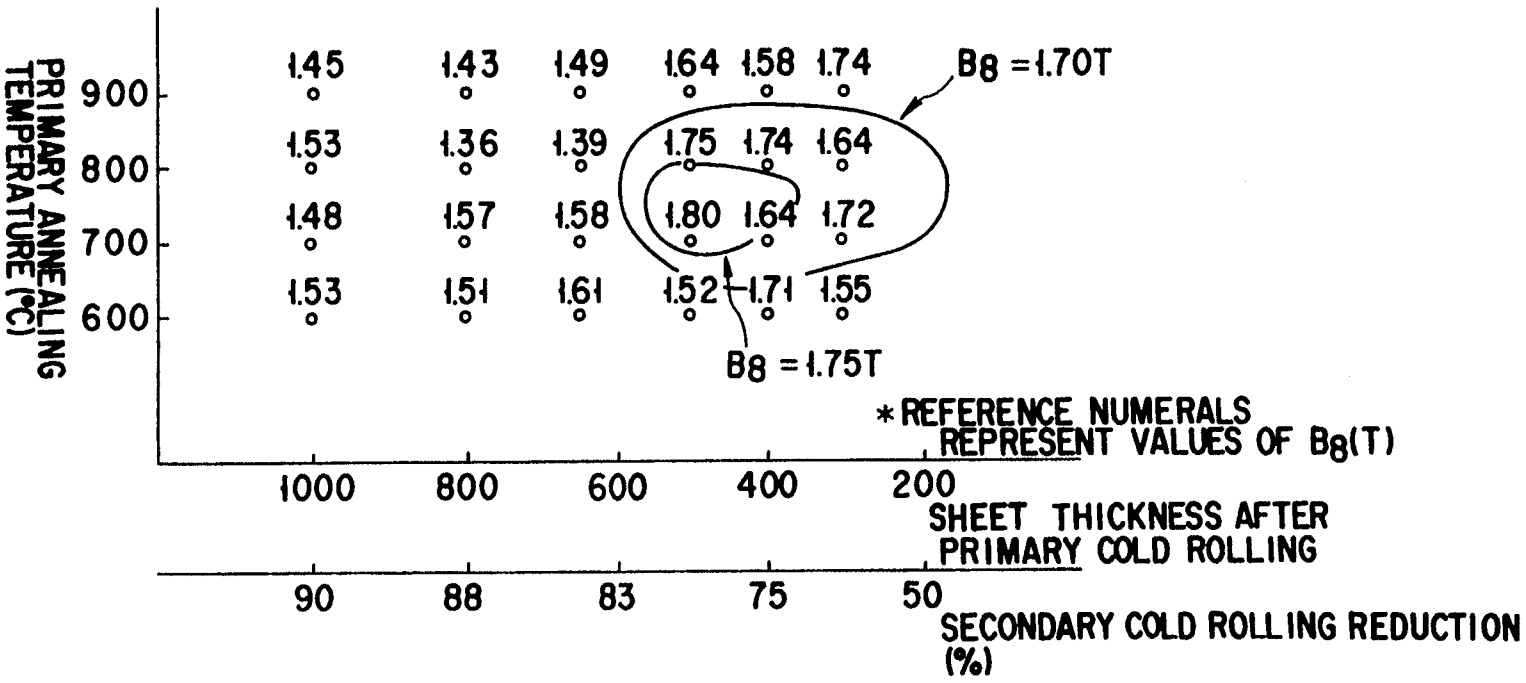
FIG. 14 is a graph showing the DC magnetic properties of steel sheets obtained by the secondary annealing, according to the Example 7.

FIG. 14 shows values of magnetic flux density $B_8$ of steel sheets after the secondary annealing at various secondary cold rolling reductions and primary annealing temperatures. It is clear from this figure that a steel sheet having good properties including $B_8 \geqq 1.7$ T can be obtained by setting the secondary cold rolling reduction at 80% or less, and the primary annealing temperature within the range of 700° to 800° C.

Example 8

Hot-rolled sheets similar to those of example 7 were pickled to remove the layer of oxides of the surface area of each sheet. Then, each sheet was subjected to the primary cold rolling at a rolling reduction in the range from 40% (at which the sheet had a thickness of 1 mm) to 85% (at which the sheet had a thickness of 0.3 mm). After that, each steel sheet was subjected to annealing at a temperature of 700° C. for 1 hour in a non-oxidation atmosphere.

Each steel sheet was further subjected to the secondary annealing in a vacuum atmosphere wherein the oxygen partial. pressure was 0.5 Pa or lower, at a temperature 1250° C. for 5 hours.

Figure 15:
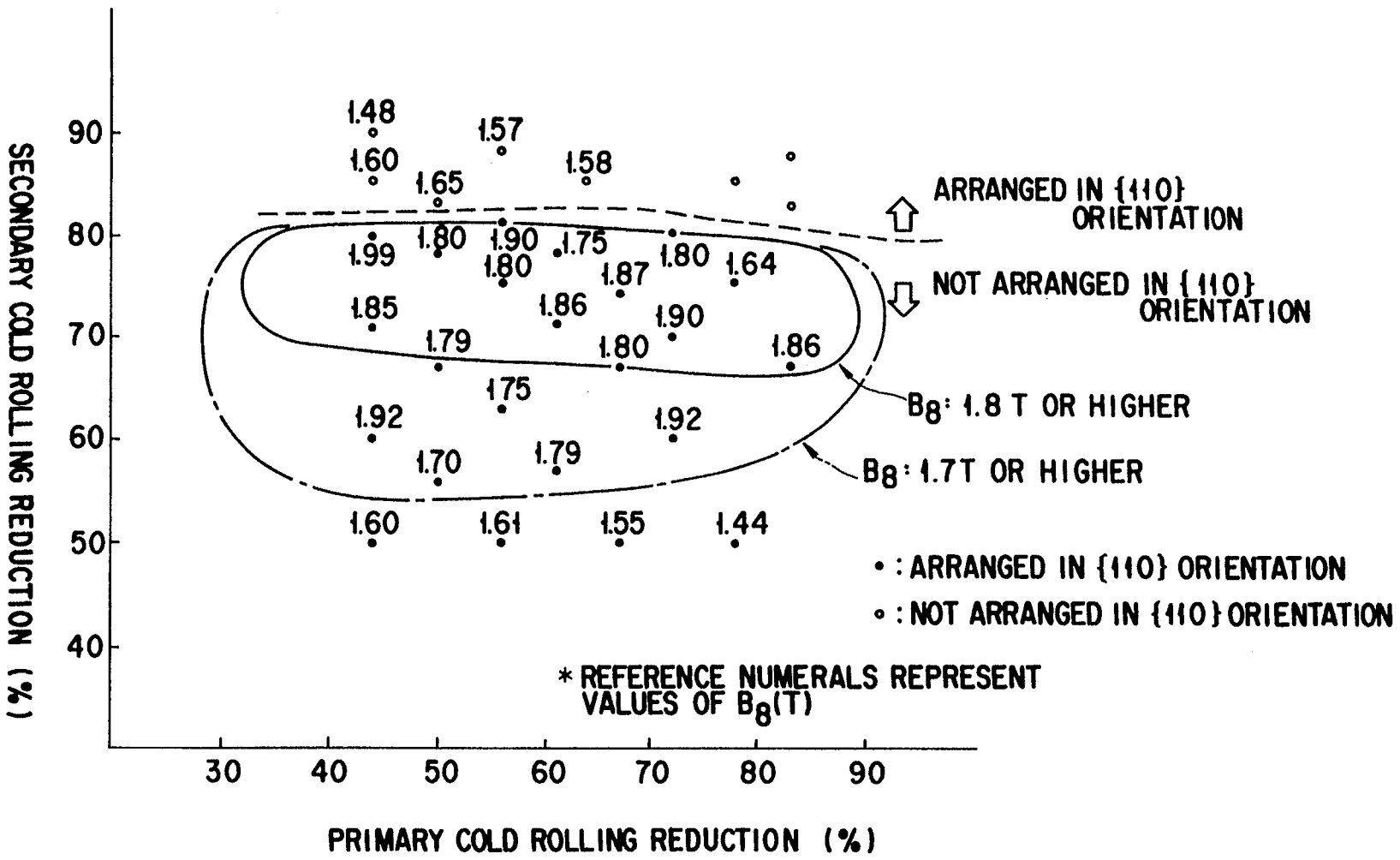
FIG. 15 is a graph showing the DC magnetic properties of steel sheets according to the Example 9.
Figure 16:
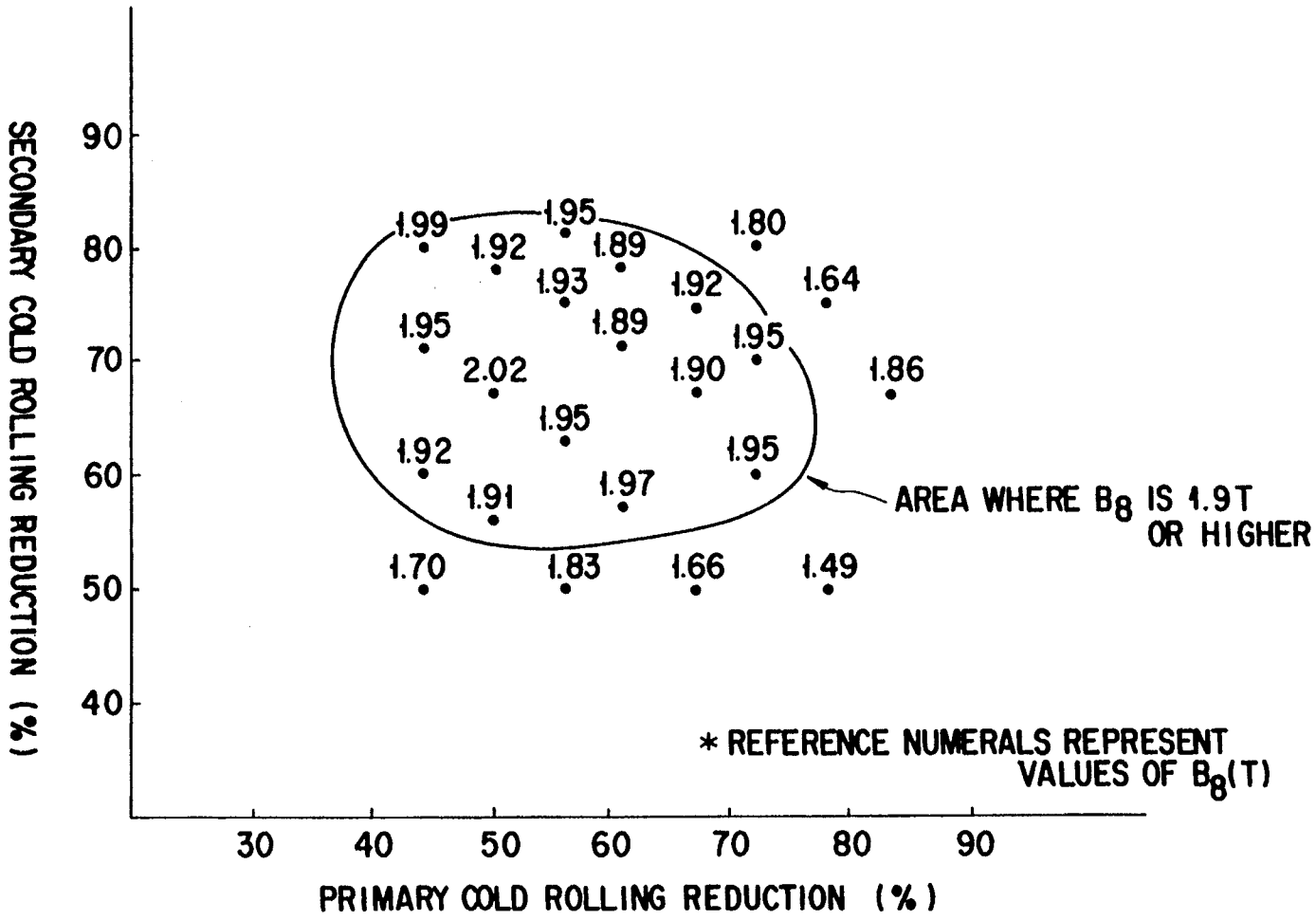
FIG. 16 is a graph showing the DC magnetic properties of steel sheets according to the Example 10.

Each steel sheet thus obtained was measured with regard to the DC magnetic properties. FIG. 15 shows the results of the measurement, and plots values of magnetic flux density $B_8$ of steel sheets after the secondary annealing at various secondary cold rolling reductions and primary annealing temperatures. In this figure, a circle represents a steel sheet in which grains of the surface area are not arranged in the {110} orientation, whereas a dot represents a steel sheet in which grains of the surface area are arranged in the {110} orientation.

As is clear from the figure, in the case where the secondary cold rolling reduction exceeded 80%, arrangement of grains in the {110} orientation was not observed, and the magnetic flux density of the sheet was low. In contrast, in the case where the secondary cold rolling rate was in the range of 50 to 80%, and the primary cold rolling reduction was 60% or less, the magnetic flux density was as high as 1.6 T or even higher. Further, in the case where the secondary cold rolling reduction was 55% or more, a magnetic flux density of 1.7 T or higher was achieved, and further, at a rolling reduction of around 70%, a high flux density of 1.8 T or even higher can be achieved.

Example 9

Hot-rolled sheets similar to those of example 7 were pickled to remove the layer of oxides of the surface area of each sheet. Then, each sheet was subjected to cold rolling (primary cold rolling) until the sheet had a thickness of 0.8 mm (rolling reduction: 55.6%). After that, each steel sheet was subjected to annealing at a temperature of 700° C. for 1 hour, and for 3 hours, at a temperature of 1000° C. for 1 minute.

Each steel sheet was further subjected to the secondary cold rolling until the sheet had a thickness of 0.3 mm (rolling reduction: 62.5%), and then to the secondary annealing in a vacuum atmosphere wherein the oxygen partial pressure was 0.5 Pa or lower, at a temperature 1200° C. for 10 hours.

Each steel sheet thus obtained was measured with regard to the DC magnetic properties. Table. 5 shows the results of the measurement.

TABLE 5

| Conditions of primary annealing | $B_8$ (T) |
|---|---|
| 700° C. × 1 hour | 1.72 |
| 700° C. × 3 hours | 1.75 |
| 1000° C. × 1 minute | 1.42 |

As can be seen in Table 5, those annealed at 700° C. in the primary annealing exhibited good magnetic properties including $B_8 \geqq 1.7$ T.

Further, these steel sheets were subjected to the tertiary cold rolling to prepare sheets having a thickness of 0.06 mm (rolling reduction: 80%) and those having a thickness of 0.03 mm (rolling reduction: 90%). Then, each sheet was subjected to the tertiary annealing in a vacuum atmosphere wherein the oxygen partial pressure was 0.5 Pa or lower, at a temperature 1200° C. for 1 hour, and thus obtained sheet was measured with regard to the DC magnetic characteristics. Table 6 shows the results of the measurement. In Table 6, the samples prepared by the same conditions are designated by the sample numbers. It was confirmed from Table 6 that regardless of the conditions of the primary annealing, sheets each having an extremely high magnetic flux density can be stably manufactured by carrying out the tertiary rolling and annealing under particular conditions.

TABLE 6

| | Conditions of primary annealing | | | | | | | | | | | |
|---|---|---|---|---|---|---|---|---|---|---|---|---|
| | 700° C. × 1 hour | | | | 700° C. × 3 hours | | | | 1000° C. × 1 hour | | | |
| | thickness of plate at final stage | | | | | | | | | | | |
| | 30 μm | | 60 μm | | 30 μm | | 60 μm | | 30 μm | | 60 μm | |
| Magnetic flux density $B_8$ (T) | 1 | 1.09 | 1 | 1.91 | 1 | 1.92 | 1 | 1.87 | 1 | 1.87 | 1 | 1.84 |
| | 2 | 1.79 | 2 | 1.89 | 2 | 1.95 | 2 | 1.91 | 2 | 1.60 | 2 | 1.83 |
| | 3 | 1.91 | 3 | 1.88 | 3 | 1.94 | 3 | 1.85 | 3 | 1.65 | 3 | 1.79 |
| | 4 | 1.94 | 4 | 1.94 | 4 | 1.92 | 4 | 1.89 | 4 | 1.72 | 4 | 1.80 |
| | 5 | 1.98 | 5 | 1.93 | 5 | 1.90 | 5 | 1.98 | 5 | 1.70 | 5 | 1.65 |
| | 6 | 2.00 | 6 | 1.90 | | | | | | | | |
| | 7 | 1.89 | 7 | 1.88 | | | | | | | | |
| | 8 | 1.85 | 8 | 1.90 | | | | | | | | |

Example 10

Some of the steel sheets obtained in Example 8 (those other than those already cold-rolled to a thickness of 0.01 mm) were subjected to the tertiary cold rolling until the sheets had a thickness of 0.1 mm (rolling reduction: 30% or higher). Then, each sheet was subjected to the tertiary annealing in a vacuum atmosphere wherein the oxygen partial pressure was 0.5 Pa or lower, at a temperature 1050° C. for 1 hour, and each sheet thus obtained was measured with regard to the DC magnetic properties. Table 6 shows the results of the measurement.

As is clear from this figure, after the tertiary annealing, the steel sheets having a magnetic flux density of 1.7 T or higher at the point of example 8 (see FIG. 15) exhibited a high magnetic flux density of 1.9 T or even higher.

Example 11

Steel materials A1 to $B_3$ having the chemical compositions shown in the aforementioned Table 3 were made into ingots, and then each of the ingots was hot-rolled into a sheet under the conditions, i.e. the finishing temperature: 800° C., the winding temperature: 610° C., and the thickness of finished sheet: 1.8 mm. Each of thus obtained hot-rolled sheets was pickled to remove the layer of oxides formed on the surface area, and subjected to the primary cold rolling until the sheet had a thickness of 0.8 mm (rolling reduction: 55.6%). Then, the steel sheet was subjected to the primary annealing at 750° C. for 1 hour.

Each primary-annealed steel sheet was then subjected to the secondary cold rolling such that the sheet had a thickness of 0.30 mm, and each steel sheet was further subjected to the secondary annealing in a hydrogen atmosphere wherein the oxygen partial pressure is 0.5 Pa or lower, at a temperature of 1180° C. for 10 hours. The sheets thus obtained were measured with regard to magnetic flux density $B_8$ by use of a DC BH-loop tracer. The shape of the sample was the same as that of example 1. The results are shown in Table 7 below.

TABLE 7

| Type of steel | magnetic flux density $B_8$ (T) |
|---|---|
| A1 | 1.75 |
| A2 | 1.68 |
| A3 | 1.52 |
| A1 | 1.76 |
| A2 | 1.65 |
| A3 | 1.48 |

As is clear from Table 7, a high magnetic flux density can be obtained when Cu or Al content is 0.01 wt. % or less.

Example 12

A steel material having the chemical composition shown in Table 1 was made into ingots, and then each of the ingots was hot-rolled into a sheet under the conditions, i.e. the finishing temperature: 800° C., the winding temperature: 600° C., and the thickness of finished sheet: 1.8 mm. Thus obtained hot-rolled sheet was pickled to remove the layer of oxides formed on the surface area, and subjected to cold rolling at a rolling rate of 40 to 98%. Each steel sheet was further subjected to annealing in a vacuum atmosphere wherein the oxygen partial pressure is 0.25 Pa, at a temperature of 1200° C. for 14 hours. An etch pit observation of crystal orientation, and measurement of $B_8$ by means of a DC magnetic measurement device were carried out regarding each sheet thus obtained.

Figure 17:
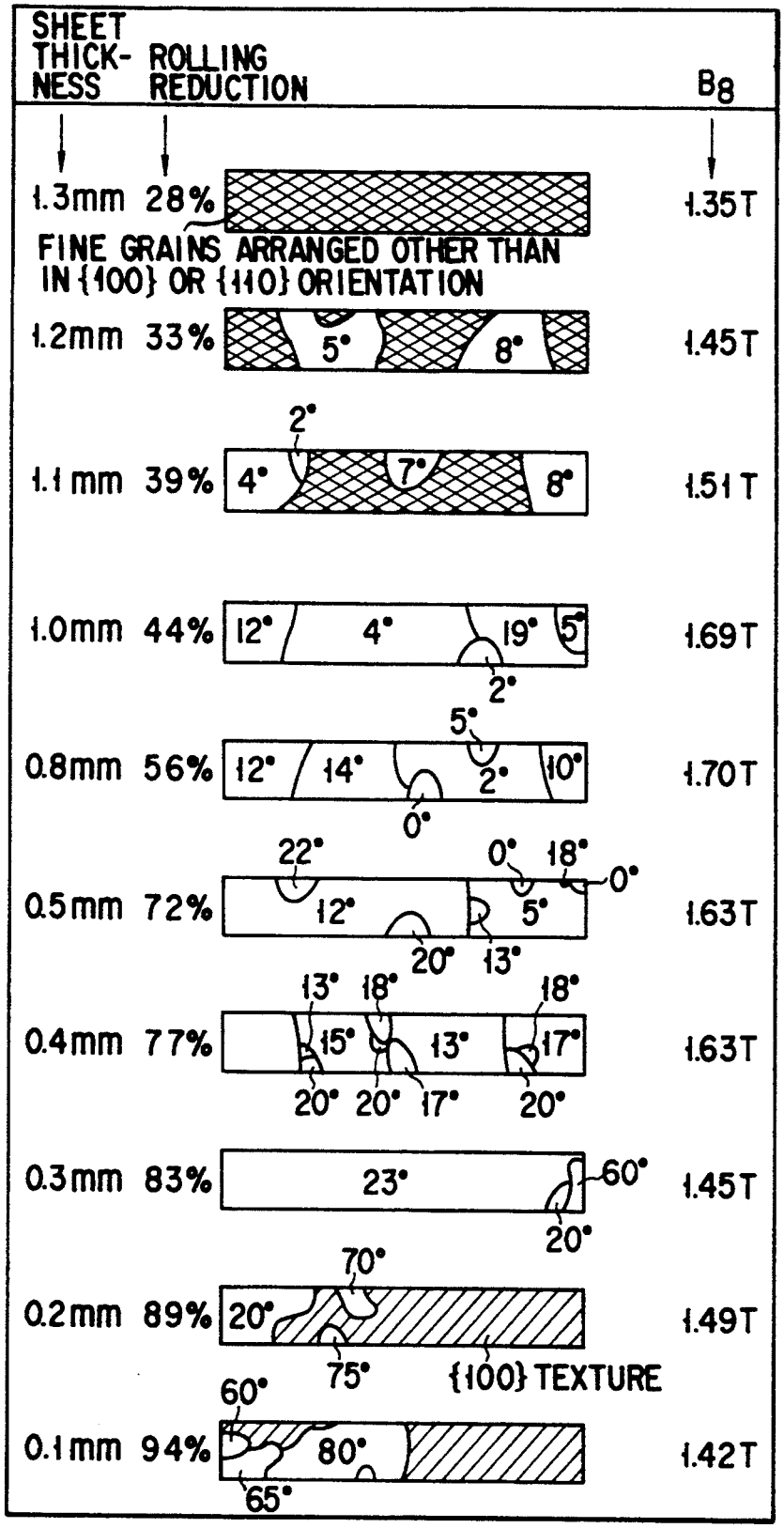
FIG. 17 shows the result of an etched pitch observation at a rolling reduction of each of the sheets according to the Example 11.

FIG. 17 shows the results of the etch pit observation of the steel sheets rolled at different rolling rates. Numerals each represent deviation from the rolling direction of the <001> axis. values of $B_8$ are also shown in this figure. As can be understood from FIG. 17, those processed at a rolling reduction of less than 40% did not exhibit a sufficient growth of coarse crystal grains, and therefore the Goss texture was not obtained. The reason, we believe, that no Goss texture was obtained is because the effect of the surface energy is relatively small. In contrast, in the case where the rolling reduction was in the range of 40 to 80%, all the surface area was covered by Goss grains with a deviated angle of 20° or less.

Figure 18:
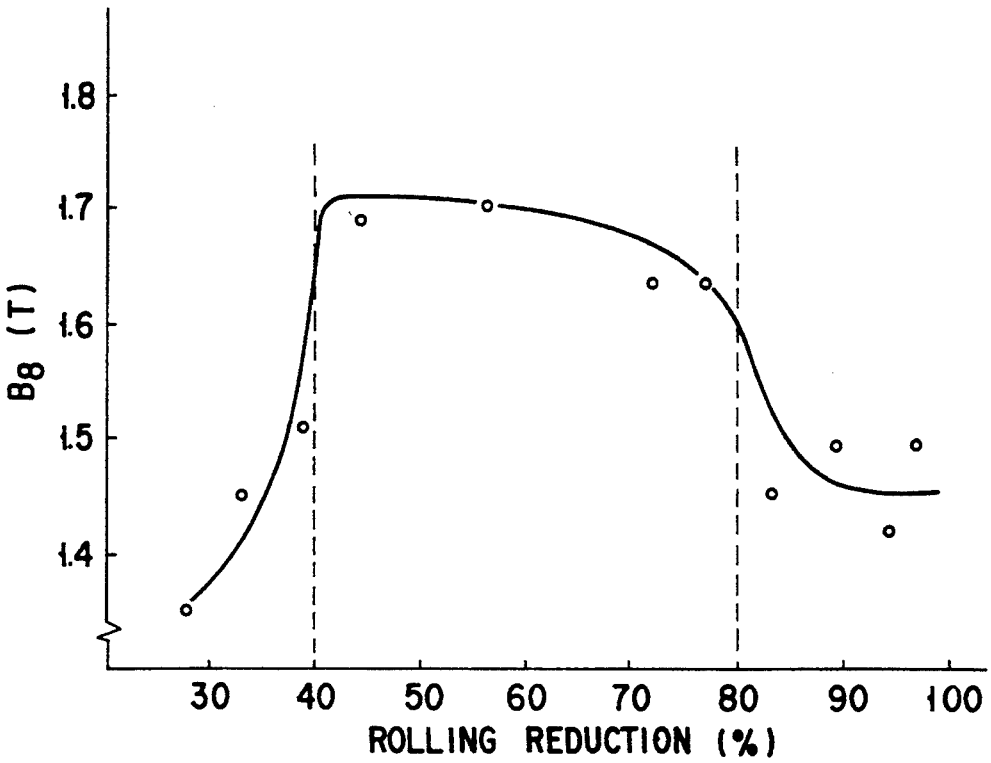
FIG. 18 is a graph showing how a cold rolling reduction influences the magnetic flux density $B_8$ of each of the sheets according to the Example 11.

FIG. 18 shows influences of cold rolling reductions on $B_8$. As can be seen from this figure, good DC magnetic properties, e.g. $B_8 \geqq 1.60$ T can be achieved by setting the rolling reduction in the range of 40 to 80%.

Example 13

A steel material having the chemical composition shown in Table 8 was made into ingots, and then each of the ingots was hot-rolled into a sheet under the conditions, i.e. the finishing temperature: 900° C., the winding temperature: 600° C., and the thickness of finished sheet: 1.8 mm.

TABLE 8

| Content (wt %) | | | | | | | | | |
|---|---|---|---|---|---|---|---|---|---|
| C | Si | Mn | P | S | Sol.Al | N | Cu | Mo | O |
| 0.004 | 2.98 | 0.01 | 0.002 | 0.005 | 0.003 | 0.0032 | <0.01 | <0.01 | 0.0020 |

Thus obtained hot-rolled sheet was pickled to remove the layer of oxides formed on the surface area, and subjected to cold rolling at a rolling reduction of 40 to 80%. Then, the steel sheet was subjected to annealing at a temperature in the range of 700° to 1300° C. in a 100% hydrogen atmosphere or in a vacuum atmosphere wherein oxygen partial pressure was 0.5 Pa or less. It was observed that in the case where the annealing was carried out in the 100% hydrogen atmosphere, coarse grains were grown on all the surface of each sheet at a temperature of 1100° C. or higher, whereas in the case where the annealing was carried out in the vacuum atmosphere, coarse grains were grown on all the surface at a temperature of 1000° C. or higher.

Each steel sheet having the surface area all covered with the coarse grains was subjected to the second cold rolling at a rolling reduction varied from 70% to 97%, and then subjected to the second annealing under the same conditions as those for the primary annealing. It was observed that in the case where the annealing was carried out in the 100% hydrogen atmosphere, coarse grains were grown on all the surface of each sheet at a temperature of 1100° C. or higher, whereas in the case where the annealing was carried out in the vacuum atmosphere, coarse grains were grown on all the surface at a temperature of 1000° C. or higher.

Figure 19:
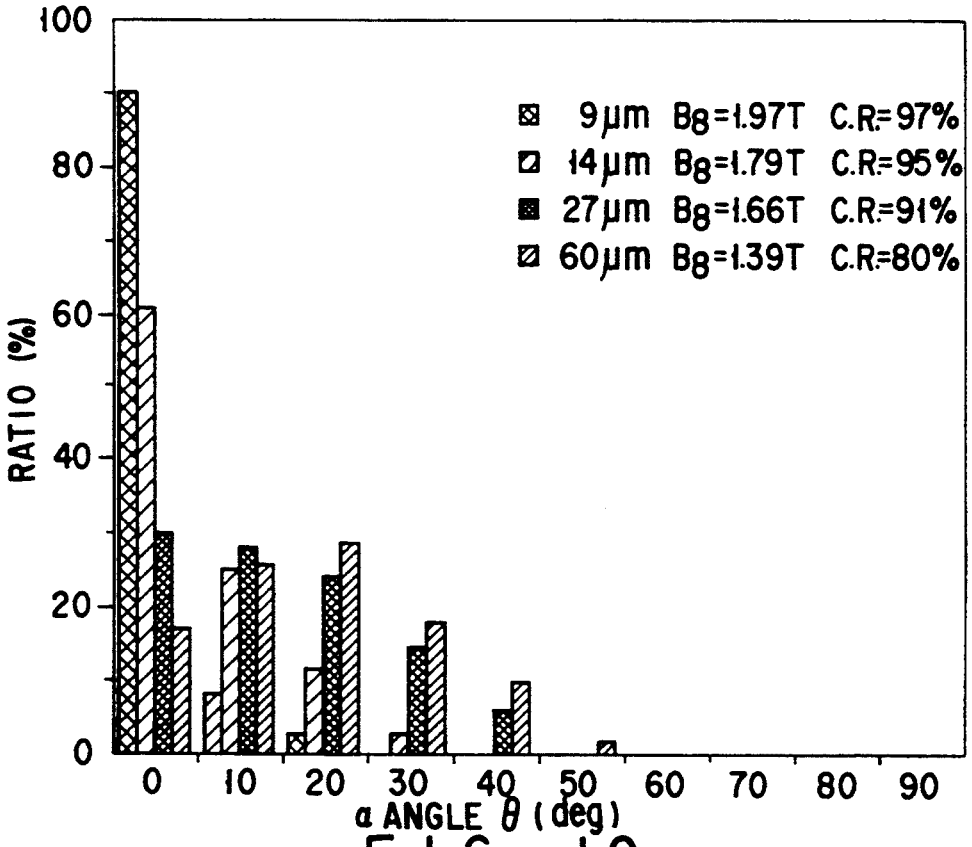
FIG. 19 is a graph showing a distribution of displaced angle $\alpha$ of steel sheets each having a thickness, according to the Example 12.

According to the analysis of variance of the crystal orientation regarding the steel sheet having the surface area covered with coarse grains, deviated angle $\alpha$ between the rolling direction and the <001> axis had a distribution shown in FIG. 19. As can be seen in the figure, when the secondary cold rolling reduction is 90% or higher, 90% or more of the crystal grains exhibit $\alpha \geqq 5°$.

Figure 20:
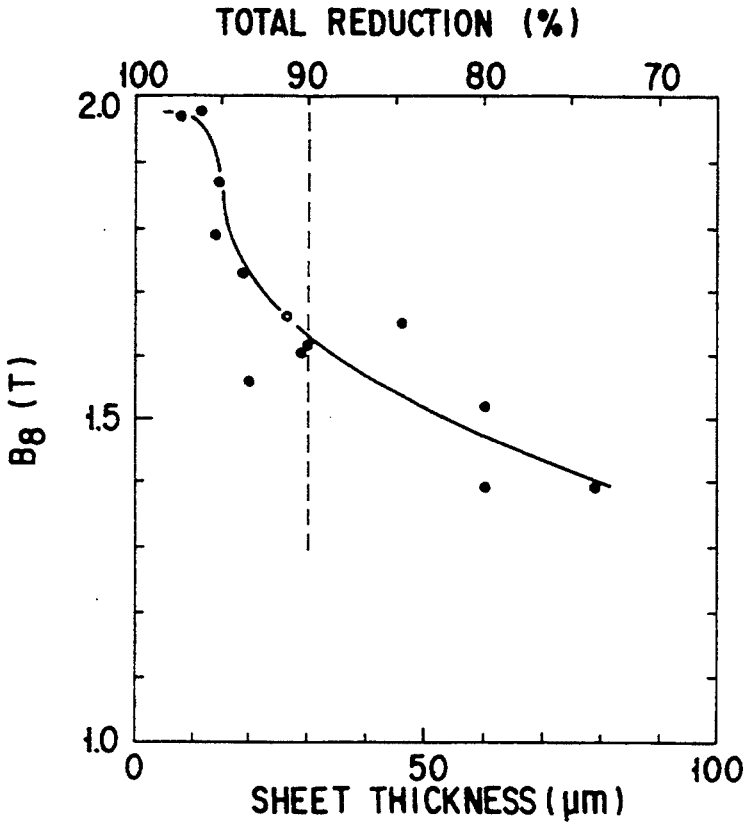
FIG. 20 is a graph showing the relationship between the secondary cold rolling reduction (or the thickness at the final stage), and the magnetic flux density $B_8$ of a steel sheet according to the twenty-first embodiment.

Further, these steel sheets were measured with regard to magnetic flux density $B_8$ by use of a DC magnetic-force measurement device. As shown in FIG. 20, when the secondary cold rolling reduction is 90% or more, $B_8$1.6 T. Further, when the rolling reduction is 95% or more, the magnetic properties obtained are better, e.g. $B_8$1.85 T.

Figure 21:
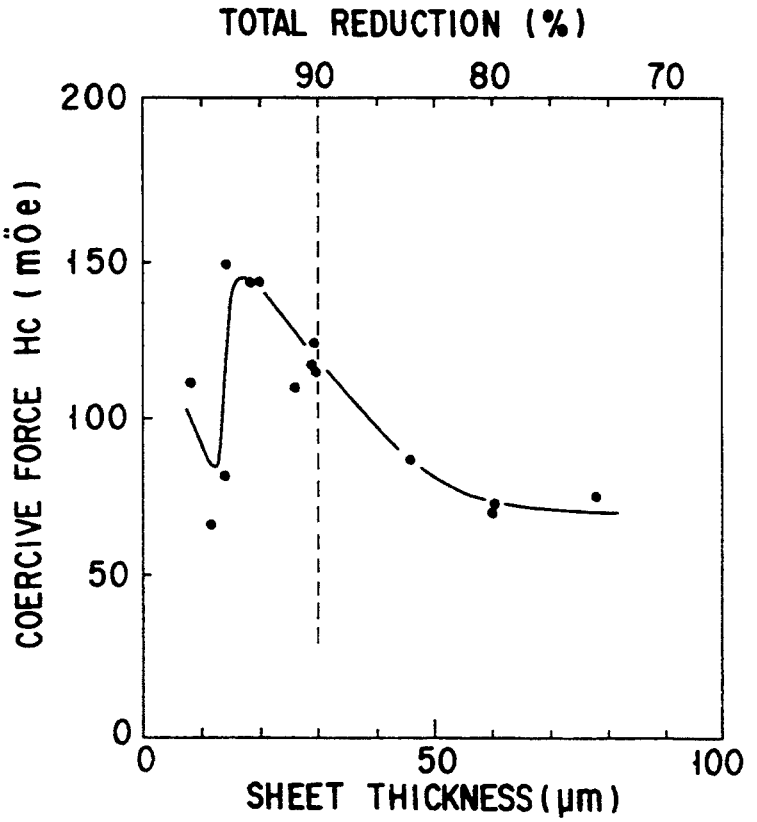
FIG. 21 is a graph showing the relationship between the secondary cold rolling reduction (or the thickness at the final stage), and the coercive force Hc of a steel sheet, according to the Example 12.

FIG. 21 shows coercive force Hc of each sheet measured by a DC magnetic measurement device. As shown in this figure, the coercive force sharply drops near the rolling reduction of 95%, and those manufactured at a rolling reduction of 95% or higher, exhibit extremely good soft magnetic properties.

Example 14

Steel materials A1 to B3 having the chemical compositions shown in the aforementioned Table 3 were made into ingots, and then each of the ingots was hot-rolled into a sheet under the conditions, i.e. the finishing temperature: 800° C., the winding temperature: 610° C., and the thickness of finished sheet: 1.8 mm. Each of thus obtained hot-rolled sheets was pickled to remove the layer of oxides formed on the surface area, and subjected to cold rolling until the sheet had a thickness of 0.8 mm (rolling reduction: 55.6% . Then, the steel sheet was subjected to annealing at 1180° C. for 10 hours in a hydrogen atmosphere wherein the oxygen partial pressure is 0.5 Pa or lower. The sheets thus obtained were measured with regard to magnetic flux density $B_8$ by use of a DC magnetic-force measurement device. The results are shown in Table 9 below.

TABLE 9

| Type of steel | magnetic flux density $B_8$ (T) |
|---|---|
| A1 | 1.70 |
| A2 | 1.58 |
| A3 | 1.42 |
| B1 | 1.69 |
| B2 | 1.53 |
| B3 | 1.41 |

As is clear from Table 9, a high magnetic flux density can be obtained when Cu or Al content is 0.01 wt. % or less.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a silicon steel sheet having grains precisely arranged in Goss orientation, comprising the steps of:

(a) preparing a steel material containing 0.01 wt. % or less of C, 2.5 to 7.0 wt. % of Si, 0.01 wt. % or less of S, 0.01 wt. % or less of Al, 0.01 wt. % or less of N;

(b) subjecting the steel material at a temperature of 1000° C. or higher to hot rolling such that the temperature of the resultant rolled material at an end of the hot rolling is 700° to 950° C.;

(c) subjecting the steel material from step (b) to a primary cold rolling process at a rolling reduction of 30 to 85%;

(d) annealing the steel material from step(c) at a temperature of 600° to 900° C.;

(e) subjecting the steel material from step (d) to a secondary cold rolling process at a rolling reduction of 40 to 80%;

(f) annealing the steel material from step (e) at a temperature of 600° to 900° C.;

(g) subjecting the steel material from step (f) to a tertiary cold rolling process at a rolling reduction of 50 to 75%; and (h) annealing the steel material from step (g) in a reducing atmosphere, or in a non-oxidizing atmosphere having an oxygen partial pressure of 0.5 Pa or less, or in a vacuum having an oxygen partial pressure of 0.5 Pa or less, at a temperature of 1000° to 1300° C.

2. The method according to claim 1, wherein said steel material contains no more than 0.01 wt. % of Cu.

3. The method according to claim 1, wherein said Al is in no more than 0.005 wt. %.

4. The method according to claim 5, wherein said Cu is no more than 0.005 wt. %.

5. The method according to claim 1, wherein Sn is no more than 0.01 wt. %, V is no more than 0 01 wt., % Zn is no more than 0.01 wt. %, and 0 is no more than 0.008 wt. %.

6. The method according to claim 5, wherein Sn is no more than 0 005 wt. %, V is no more than 0 005 wt. %, and Zn is no more than 0.005 wt. %.

7. The method according to claim 6, wherein the annealing in steps (d) and (f) are carried out at a temperature of 680° to 800° C. for least 2 minutes.

8. The method according to claim 7, wherein in step (h), the annealing is carried out for at least 3 minutes.

9. The method according to claim 1, wherein during step (h), crystal grains are grown by surface energy and thus Goss grains are grown.

10. The method according to claim 1 wherein the steel material contains 0.005 wt. % C, 3.02 wt. % Si, 0.01 wt. % Mn, 0.004 wt. % P, 0.002 wt. % S, 0.004 wt. % Al, 0.0015 wt. % N, less than 0.01 wt. % Cu, less than 0.01 wt. % Mo and 0.0017 wt. % 0; carrying out the primary cold rolling at a rolling reduction of 39 to 78%; carrying out annealing in step (d) at 700° C. for 1 hour in the presence of an atmosphere of 100% nitrogen; carrying out step (e) at a rolling reduction of 50 to 80%; and carrying out the annealing in step (h) in an atmosphere of 100% hydrogen.

* * * * *